US008146529B2

(12) United States Patent
Hakamata et al.

(10) Patent No.: US 8,146,529 B2
(45) Date of Patent: Apr. 3, 2012

(54) LIQUID APPLICATION APPARATUS AND PRINTING APPARATUS

(75) Inventors: Keisei Hakamata, Tokyo (JP); Tetsuyo Ohashi, Yokohama (JP); Hideaki Nagahara, Yokohama (JP); Hiroshi Yoshino, Kawasaki (JP); Takeshi Sekino, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 458 days.

(21) Appl. No.: 12/357,876

(22) Filed: Jan. 22, 2009

(65) Prior Publication Data

US 2009/0194019 A1 Aug. 6, 2009

(30) Foreign Application Priority Data

Jan. 23, 2008 (JP) ..... 2008-013066

(51) Int. Cl.
*B05C 11/00* (2006.01)
*B05C 1/06* (2006.01)
*B05C 1/00* (2006.01)

(52) U.S. Cl. ..... 118/244; 118/665; 118/667; 118/688; 118/259; 118/262; 347/103

(58) Field of Classification Search ..... None
See application file for complete search history.

(56) References Cited

U.S. PATENT DOCUMENTS

| | | | | |
|---|---|---|---|---|
| 3,952,700 | A * | 4/1976 | Little et al. | 399/102 |
| 6,183,079 | B1 * | 2/2001 | Meade et al. | 347/101 |
| 7,395,778 | B2 | 7/2008 | Iwasaki et al. | |
| 7,588,639 | B2 | 9/2009 | Iwasaki et al. | |
| 2005/0178324 | A1 * | 8/2005 | Iwasaki et al. | 118/244 |
| 2007/0126836 | A1 | 6/2007 | Masuyama et al. | |

FOREIGN PATENT DOCUMENTS

| | | | |
|---|---|---|---|
| CN | 1660575 | A | 8/2005 |
| EP | 1564009 | A2 | 8/2005 |
| JP | 08-058069 | | 3/1996 |
| JP | 08-072227 | | 3/1996 |
| JP | 2001-070858 | | 3/2001 |
| JP | 2002-96452 | | 4/2002 |
| JP | 2002-517341 | | 6/2002 |
| JP | 2005-254229 | | 9/2005 |
| JP | 2006-346534 | A | 12/2006 |

OTHER PUBLICATIONS

Communication—Appln. No. 09151114.7-2424/2082810, European Patent Office, Nov. 26, 2009. Notification of First Office Action—App. No. 2009100011842, The State Intellectual Property Office of P.R. China, Feb. 12, 2010.
U.S. Appl. No. 12/355,410, filed Jan. 16, 2009, Hideaki Nagahara, Tetsuyo Ohashi, Hiroshi Yoshino, Takeshi Sekino, Keisei Hakamata.

* cited by examiner

*Primary Examiner* — Dah-Wei Yuan
*Assistant Examiner* — Binu Thomas
(74) *Attorney, Agent, or Firm* — Fitzpatrick, Cella, Harper & Scinto

(57) ABSTRACT

There is provided a liquid application apparatus capable of performing stable application without providing a new mechanism, by efficiently removing an application liquid increased in viscosity and fixedly adhered to an abutting portion between an application member and a liquid supplying member. A liquid application apparatus includes an application member that applies a liquid supplied to an applied face to a printing medium by rotating an application roller and a liquid holding member that abuts against the applied face to form a liquid holding space for holding the liquid, and the amount of liquid that is held in the liquid holding space and makes contact with the application member in unit time is larger before an applying operation for applying the liquid to the printing medium than in the applying operation.

11 Claims, 28 Drawing Sheets

LIQUID APPLICATION APPARATUS AND PRINTING APPARATUS

BACKGROUND OF THE INVENTION

1. Field of the Invention

The present invention relates to a liquid application apparatus and a printing apparatus, and more particularly, to a liquid application apparatus and a printing apparatus for applying a liquid to a printing medium for a predetermined purpose of accelerating coagulation of ink and the like.

2. Description of the Related Art

At present, spin coater, roll coater, bar coater, and die coater systems have been known as systems for applying a liquid or material in a liquid state to printing media to be printed by printing apparatuses. These systems assume continuously performing application to a relatively long applied medium. Therefore, when, for example, relatively small sized applying media are intermittently transferred and application is performed for these printing media, a uniform coating film may not be obtained for each applied medium due to disturbance in a coating bead at positions to start and end application thereof or the like.

As a method for solving such a problem, for example, Japanese Patent Laid-Open No. 2001-70858 discloses a method that uses a rotating rod bar in a die coater system. In the method using a rod bar, an application liquid is discharged from a discharging slit onto the rod bar to form a coating film on the rodbar. Then, the formed coating film contacts an applied medium to be transferred as a result of a rotation of the rod bar. In such a method, when the coating film formed on the rod bar is not transferred or applied to an applied medium, the application liquid returns into a head due to a rotation of the rod bar and is recovered via a recovering slit. More specifically, the rod bar continues to rotate even at the non-application time, and the application liquid has formed a coating film on the rod bar. This makes it possible, even when applying media are intermittently supplied and application is intermittently performed for those, to obtain a uniform coating film.

In addition, for example, Japanese Patent Laid-Open No. 2002-517341 discloses a technique which uses a doctor blade being in contact with a roller for accumulating an application liquid between the blade and roller, and imparts the application liquid to the roller as a result of a rotation of the roller. In the present technique, as a result of a rotation of the roller, the application liquid that has been imparted is transferred and applied to a support to be conveyed between the roller and another roller. Further, Japanese Patent Laid-Open No. H08-72227 (1996) discloses a mechanism that applies in advance a processing liquid (application liquid) to insolubilize a dye prior to printing. In the technique, the application liquid in a replenishment tank is drawn out by being adhered to a rotating roller, and the drawn-out application liquid is simultaneously applied to a printing medium.

According to each of the techniques disclosed in the above patent documents, while a rod bar or a roller rotates, an application liquid is imparted and supplied to the surface of the bar or roller. A part opened to the atmospheric air or communicated therewith performs the imparting and supplying. Therefore, the application liquid possibly evaporates. Moreover, when the apparatus is changed in posture, the application liquid may leak accordingly.

To cope therewith, it has been known to seal a part to impart and supply a liquid such as ink to a roller. In, for example, an apparatus disclosed in Japanese Patent Laid-Open No. H08-58069 (1996), an ink chamber having doctor blades is abutted against the peripheral surface of a roller to thereby form a liquid chamber (ink reservoir) with respect to the roller. This allows suppressing evaporation and leakage of the liquid.

Further, an apparatus disclosed in Japanese Patent Laid-Open No. 2005-254229 can, by abutting an annular-shaped member against a roller to form a hermetically-sealed region to hold an application liquid, prevent the liquid from evaporating.

However, in the application mechanisms disclosed in Japanese Patent Laid-Open No. H08-58069 (1996) and Japanese Patent Laid-Open No. 2005-254229, the application liquid is to remain on the doctor blade that scrapes away the application liquid or the seal plate. Although it is possible to reduce the same by utilizing an interval regulating plate or by using a water-repellent material, the application liquid remains in a nip portion between the application member and liquid chamber and the vicinity thereof. When the apparatus is kept stopped in this state for an extended period of time, the application liquid interposed between the application member and liquid chamber and in the vicinity thereof may be increased in viscosity so that the application liquid is fixedly adhered. In the case of an increase in viscosity and fixed adhesion of the application liquid in the nip portion between the application member and liquid chamber, a large amount of application liquid adheres to only a part, on the application member, corresponding to the nip portion with the liquid chamber, and it becomes difficult to form a uniform layer on the surface of the application member. Therefore, the application liquid may partially become nonuniform.

To cope therewith, a technique disclosed in Japanese Patent Laid-Open No. 2002-96452 discloses a unit for performing a roller rotating operation at regular time intervals in a standby state for a printing operation so as to prevent fixed adhesion. In a printing apparatus disclosed in Japanese Patent Laid-Open No. 2002-96452, by performing an idle rotation of a roller at regular time intervals during standby for a printing operation, an application liquid increased in viscosity that has been adhered on to the roller is returned to a normal viscosity. Then, by separating the opposed roller at the elapse of every regular time interval, the application liquid is suppressed from fixedly adhering to the nip portion.

However, according to the technique disclosed in Japanese Patent Laid-Open No. 2002-96452, since the operation is performed at the elapse of every regular time interval during standby, the longer the standby time, the more power consumption increases. Moreover, when the apparatus is left in a power off state, a mechanism such as a built-in power becomes necessary. Further, since the opposed roller is separated at the elapse of every regular time interval, a mechanism to separate the roller becomes necessary besides an ordinary application mechanism, so that the mechanism of an application apparatus is complicated, and it may be inevitable to increase the size of the apparatus.

SUMMARY OF THE INVENTION

The present invention has been made in view of the above problems, and it is an object of the present invention to provide a liquid application apparatus and a printing apparatus capable of performing stable application by efficiently removing an application liquid increased in viscosity and fixedly adhered to an abutting portion between an application member and a liquid supplying member, without providing a new mechanism.

In order to achieve the above-mentioned object, the present invention provides a liquid application apparatus including an application member that applies a liquid supplied to an applied face to a printing medium by rotating an application roller and a liquid holding member that abuts against the applied face to form a liquid holding space for holding the liquid, wherein the amount of liquid that is held in the liquid holding space and makes contact with the application member in unit time is larger before an applying operation for applying the liquid to the printing medium than in the applying operation.

According to the above apparatus, a liquid remaining and fixedly adhered between the application member and liquid holding member and in the vicinity thereof can be redissolved before an applying operation, and non-uniformity of a liquid to be adhered onto the surface of the application member can be suppressed. As a result, an even applying operation can be performed for a printing medium.

Further features of the present invention will become apparent from the following description of exemplary embodiments (with reference to the attached drawings).

DESCRIPTION OF THE EMBODIMENTS

Hereinafter, embodiments of the present invention will be described in detail with reference to the drawings.

First Embodiment

1. Liquid Applying Section

Figure 1:
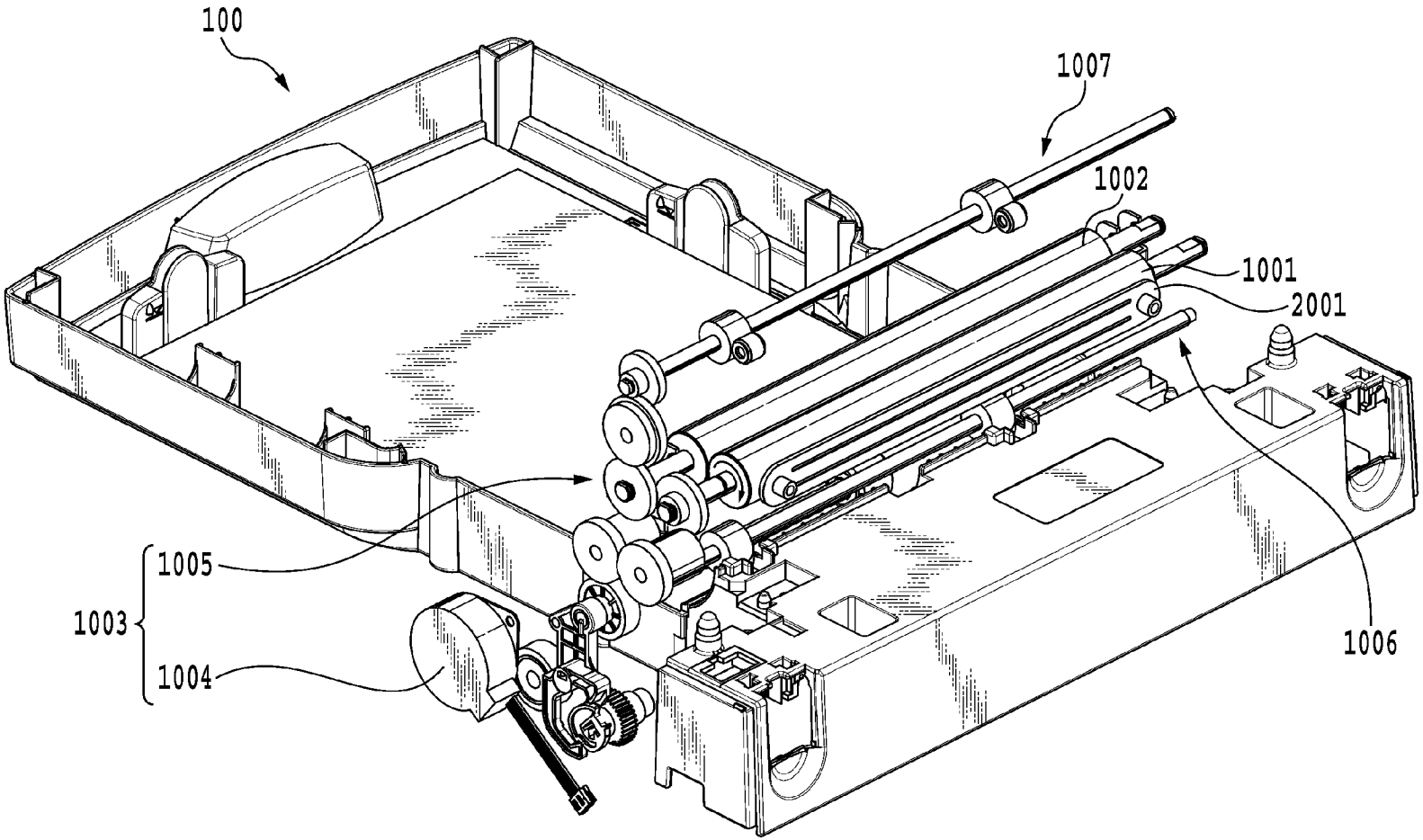
FIG. 1 is a perspective view showing the overall configuration of a liquid application mechanism of a first embodiment of the present invention.

FIG. 1 is a perspective view showing the overall configuration of a liquid application mechanism 100 of the present embodiment. The liquid application mechanism 100 has a liquid application unit for applying an application liquid onto an applied medium and a liquid supplying unit for supplying the liquid application unit with an application liquid.

The liquid application unit includes a circular cylindrical application roller 1001, a circular cylindrical counter roller (medium support member) 1002 arranged opposed to the application roller 1001, and a roller drive mechanism 1003 that drives the application roller 1001. The roller drive mechanism 1003 is composed of a roller drive motor 1004 and a power transmission mechanism 1005 having a gear train or the like to transmit a driving force of the roller drive motor 1004 to the application roller 1001. The application roller 1001 and the counter roller 1002 are, respectively, freely rotatably attached, at their both ends, to an unillustrated frame, and freely rotatably supported by mutually parallel shafts.

The liquid supplying unit includes a liquid holding member 2001 that holds an application liquid between the same and the application roller 1001, and an unillustrated liquid flow path 3000 to be described later that supplies the liquid holding member 2001 with a liquid. The liquid holding member 2001 extends almost over the entire length of the application roller 1001 in the longitudinal direction. In addition, the liquid holding member 2001 is movably attached to the unillustrated frame via a mechanism that enables an approaching and separating operation with respect to the peripheral surface of the application roller 1001.

Figure 2:
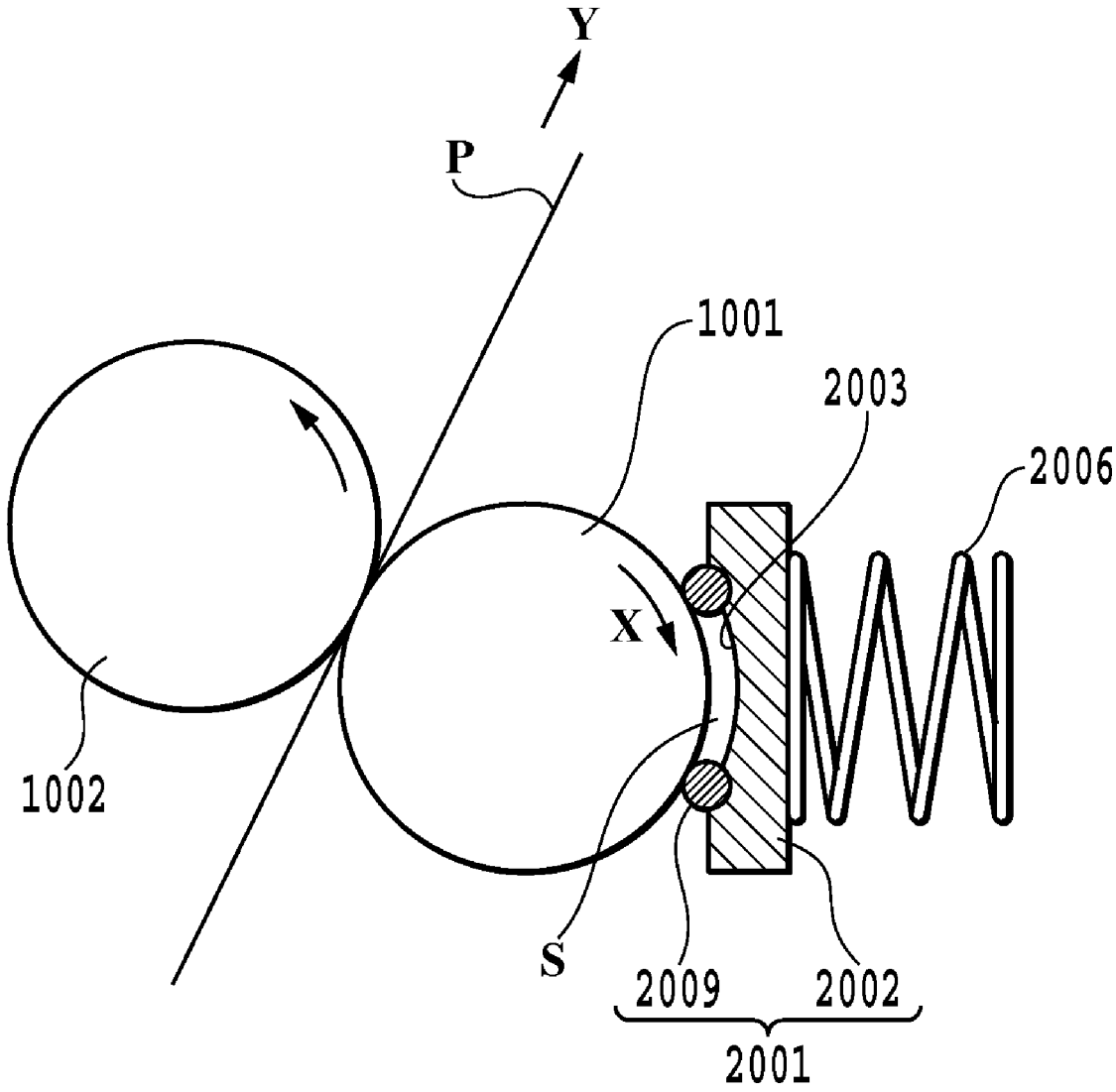
FIG. 2 is a longitudinal sectional side view showing an example of arrangement of an application roller, a counter roller, and a liquid holding member of the first embodiment of the present invention.

FIG. 2 is a longitudinal sectional side view showing an example of arrangement of the application roller 1001, the counter roller 1002, and the liquid holding member 2001. The application roller 1001 of the present embodiment is made of a silicon-based material having a rubber hardness of 20 degrees, the surface roughness is about Ra 1.0 μm to 2.0 μm, and the diameter is 23.169 mm. Moreover, the counter roller 1002 of the present embodiment is made of an iron material, and the diameter is 12 mm. Examples of the silicon-based material include liquid silicon.

The counter roller 1002 is urged toward the peripheral surface of the application roller 1001 by a spring member 2006. Due to such a construction, by rotating the application roller 1001 in the direction of an arrow X, an applied medium P to be applied can be sandwiched between both rollers, and the applied medium P is transferred in the direction of an arrow Y.

Moreover, the liquid holding member 2001, when abutting by being urged against the peripheral surface of the application roller 1001 by an urging force of the spring member 2006, forms a long liquid holding space S that extends across the entire region of liquid application by the application roller 1001. Into the liquid holding space S, an application liquid is supplied from the liquid supply flow path 3000 to be described later via the liquid holding member 2001. The liquid holding member 2001 of the present embodiment can, when the application roller 1001 is in a stopped state, prevent or reduce unexpected outward leakage of the application liquid from the liquid holding space S. Also, the liquid holding member 2001 can simultaneously suppress evaporation of the liquid.

FIG. 3 to FIG. 8 are views showing a construction of the liquid holding member 2001 of the present embodiment.

Figure 3:
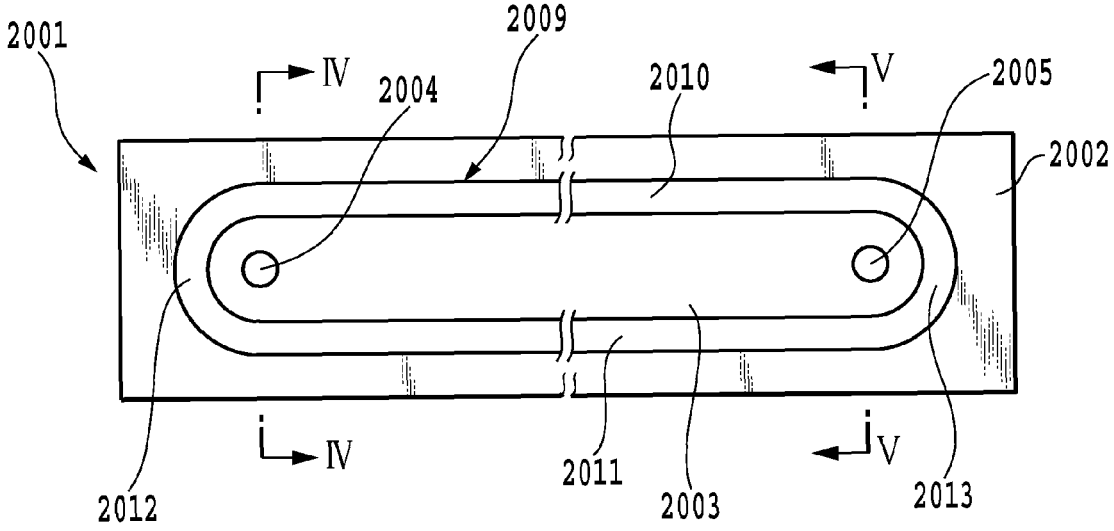
FIG. 3 is a front view showing a construction of the liquid holding member of the first embodiment of the present invention.
Figure 4:
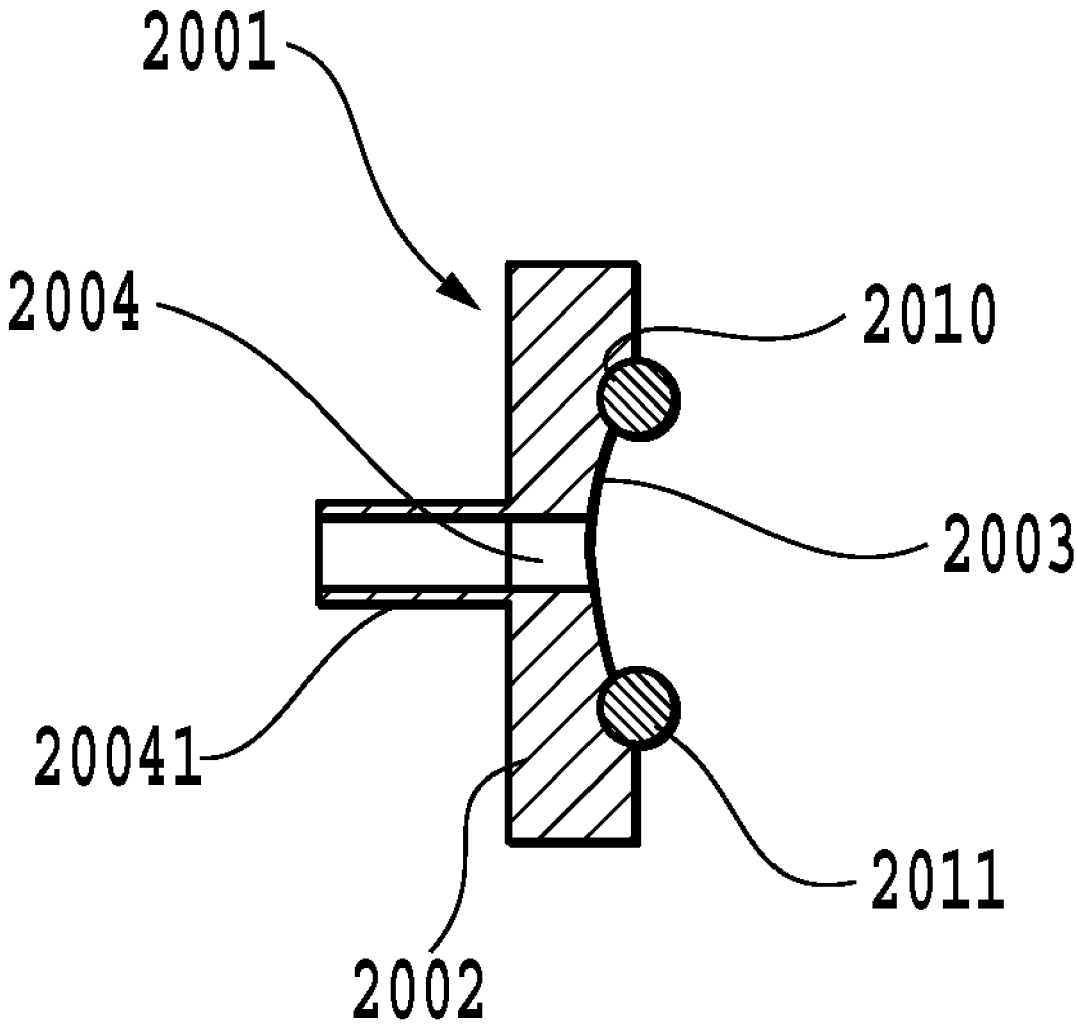
FIG. 4 is an end view showing an end face sectioned along a line IV-IV of FIG. 3.
Figure 5:
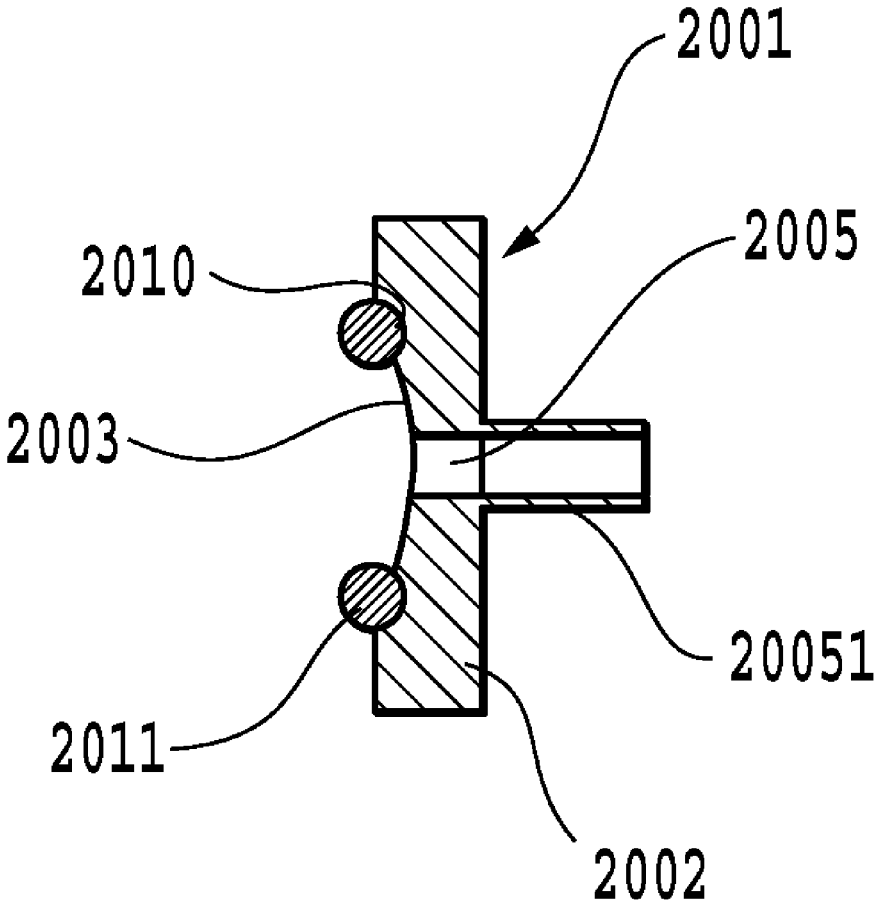
FIG. 5 is an end view showing an end face sectioned along a line V-V of FIG. 3.

FIG. 3 is a front view showing a configuration of the liquid holding member 2001, FIG. 4 is an end view showing an end face sectioned along a line IV-IV of FIG. 3, and FIG. 5 is an end view showing an end face sectioned along a line V-V of FIG. 3. In addition, FIG. 6 is a plan view showing a configuration of the liquid holding member 2001, and FIG. 7 and FIG. 8 are a left side view and a right side view showing a state where the abutting portion of a liquid application member is abutted against the liquid application roller.

As shown in FIG. 3, the liquid holding member 2001 includes a space forming base material 2002 and an annular abutting member 2009 provided on one face of the space forming base material 2002. On the space forming base material 2002, formed along the longitudinal direction in its central part is a recess portion 2003. The abutting member 2009 is fixedly attached, at is linear part, along an upper edge portion of the recess portion 2003, and is also fixedly attached, at a circumferential part, so as to lead from the upper edge portion through a bottom portion to an upper edge portion of the opposite side. Such a construction enables, when the abutting member 2009 of the liquid holding member 2001 abuts against the application roller 1001, abutting along the peripheral surface shape of the application roller, so that abutting at a uniform pressure can be realized.

As above, the liquid holding member 2001 of the present embodiment abuts, at the abutting member 2009 formed integrally without seams, against the outer peripheral surface of the application roller 1001 in a continuous state without a gap by an urging force of the spring member 2006. As a result, the liquid holding space S becomes a substantially blocked space formed by the abutting member 2009, one face of the space forming base material 2002, and the outer peripheral surface of the application roller 1001, and an application liquid is held in the space. In a state where rotation of the application roller 1001 has stopped, the abutting member 2009 and the outer peripheral surface of the application roller 1001 can maintain a liquid-tight state so as to reliably prevent the liquid from leaking outside. Also, in this case, an abutting state of the abutting member 2009 includes a state of abutting against the outer peripheral surface of the application roller 1001 via a film of the liquid formed by a capillary force, besides a state of direct contact of the abutting member 2009 with the outer peripheral surface of the application roller 1001. On the other hand, when the application roller 1001 rotates, the application liquid slides away between the outer peripheral surface of the application roller 1001 and the abutting member 2009, and adheres to the outer peripheral surface of the application roller 1001 in a layer state.

Figure 6:
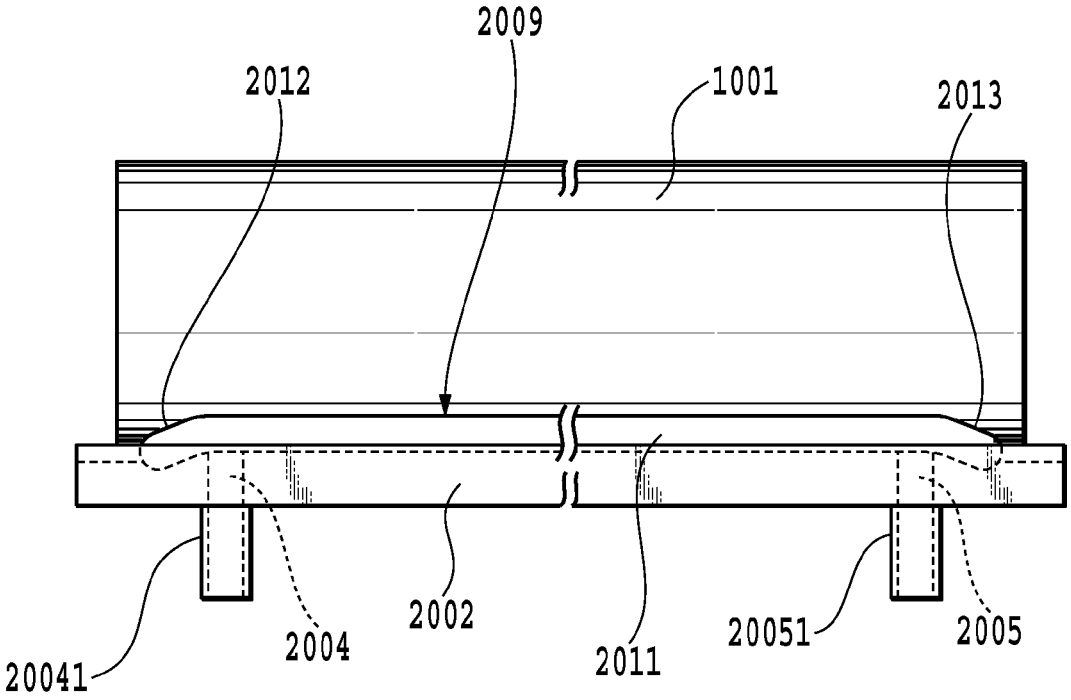
FIG. 6 is a plan view showing a construction of the liquid holding member of the first embodiment of the present invention.
Figure 7:
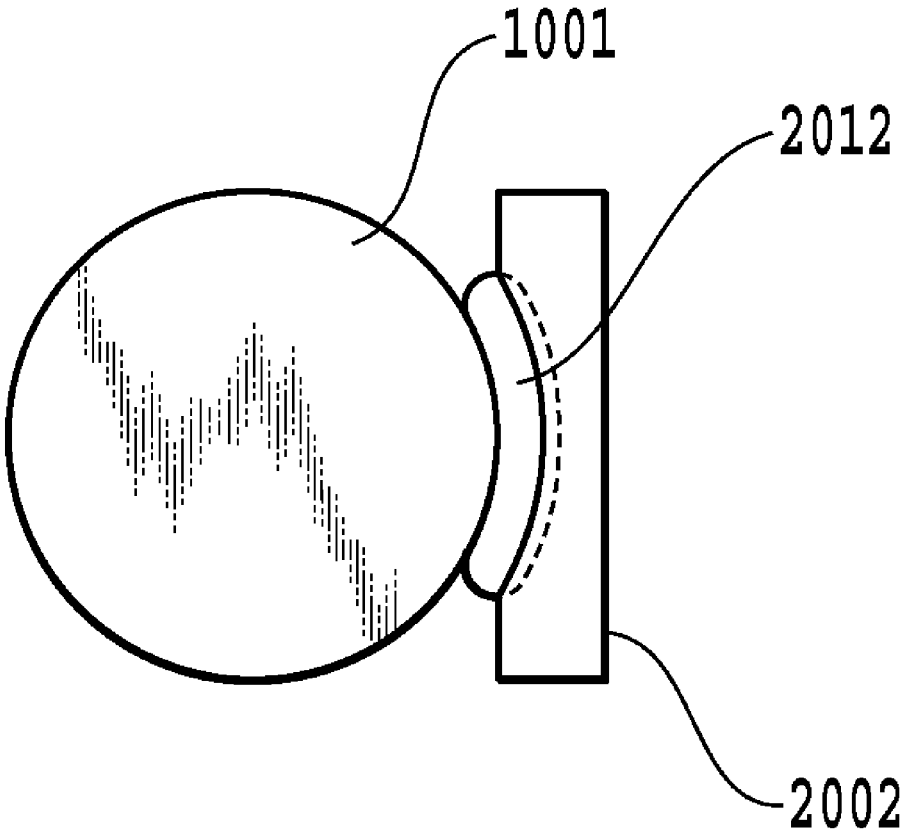
FIG. 7 is a left side view showing a state where the abutting portion of a liquid application member is abutted against the liquid application roller of the first embodiment of the present invention.
Figure 8:
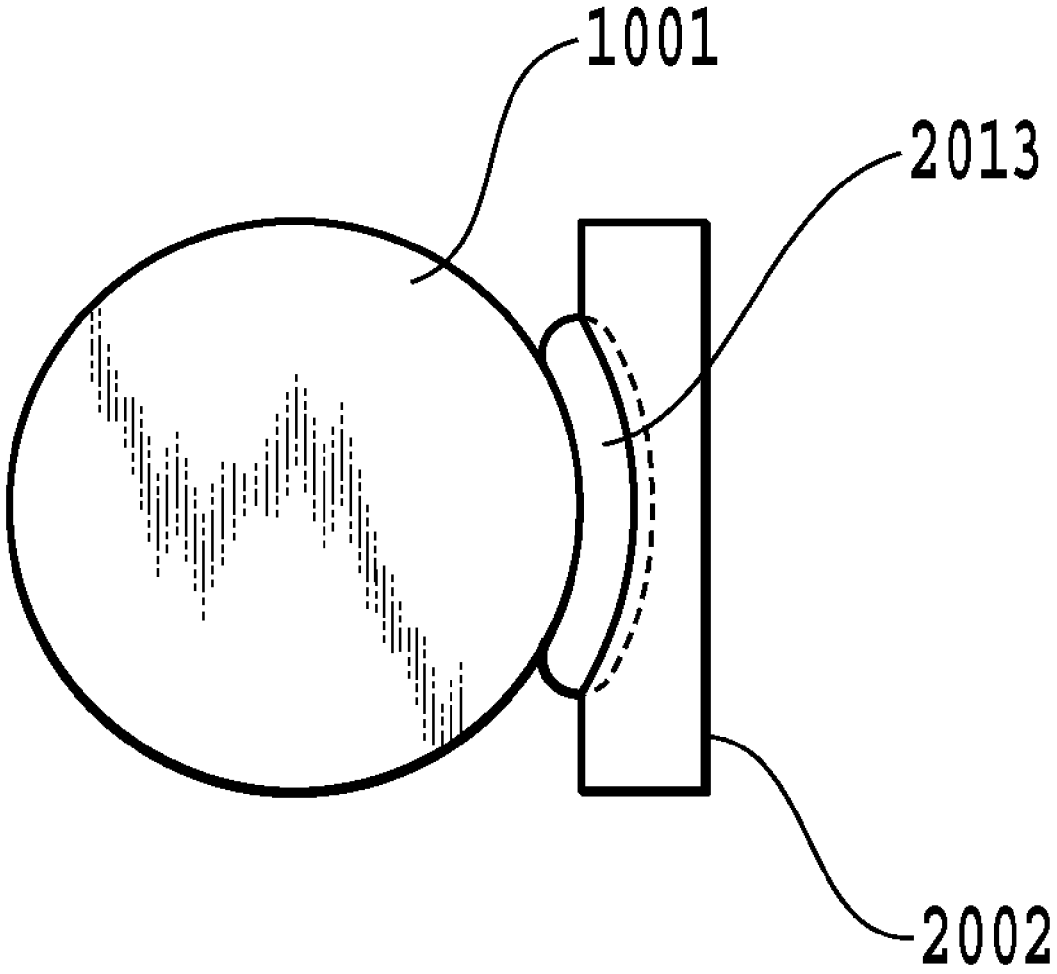
FIG. 8 is a right side view showing a state where the abutting portion of a liquid application member is abutted against the liquid application roller of the first embodiment of the present invention.

Moreover, as shown in FIG. 6 to FIG. 8, both left and right side portions in the longitudinal direction of the abutting member 2009 show gently curving shapes. Therefore, even when the abutting member 2009 is abutted by a relatively strong pressing force against the application roller 1001, the abutting member 2009 as a whole is almost uniformly elastically deformed, and no locally large distortion occurs. Therefore, the abutting member 2009 can abut against the outer peripheral surface of the application roller 1001 continuously without a gap to form a substantially blocked space. Also, the liquid holding member 2001 is of a structure that has a center of rotation at almost the outer peripheral portion of the application roller 1001 and performs alignment around the application roller.

For the space forming base material 2002, as shown in FIG. 3 to FIG. 5, a liquid supply port 2004 and a liquid recovery port 2005 respectively formed with holes that penetrate through the space forming base material 2002 are provided in a region surrounded by the abutting member 2009. These ports are respectively communicated with circular cylindrical coupling portions 20041 and 20051 provided in a protruding condition on a back face side of the space forming base material 2002. These coupling portions 20041 and 20051 are coupled to the liquid supply flow path 3000 to be described later. Also, in the present embodiment, the liquid supply port 2004 is formed in the vicinity of one end portion (the left end portion in FIG. 3) of the region surrounded by the abutting member 2009, and the liquid recovery port 2005 is provided in the vicinity of the other end portion (the right end portion in FIG. 3) of the same region. The liquid supply port 2004 is for supplying the liquid holding space S with an application liquid to be supplied from the liquid flow path 3000, and the liquid recovery port 2005 is for making the liquid in the liquid holding space S flow out to the liquid flow path 3000. As a result of performing the supply and outflow of the liquid, the application liquid flows, in the liquid holding space S, from the left end portion to the right end portion shown in FIG. 3.

2. Applying Liquid Flow Path and Liquid Circulating Section

Next, each element of an application liquid flow path and a liquid circulating section of the liquid application mechanism, which has been schematically described in the above, will be described in greater detail.

Also, the application liquid to be used in the present embodiment is a liquid used for the purpose of accelerating coagulation of pigment in the case of printing with an ink using the pigment as a coloring material. Examples of components of the liquid to be applied are as follows:

| | |
|---|---|
| Calcium nitrate tetrahydrate | 10% |
| Glycerin | 42% |
| Surfactant | 1% |

Water remainder, and the viscosity of the application liquid is 5 cP to 6 cP (centipoise) at 25° C. Also, as a matter of course, the application liquid of the present invention is not limited thereto. For example, it is also possible to use, as the application liquid, a liquid containing a component to insolubilize or aggregate a dye. It is also possible to use, as the application liquid, a liquid containing a component to suppress an applied medium from curling (a phenomenon where the medium has a curved shape).

Moreover, when water is used for the liquid to be applied, slidability at an abutting part of the liquid holding member with respect to the application roller of the present embodiment is made satisfactory by making the liquid contain a component to lower surface tension. Examples of such a component of the liquid to be applied include glycerin and surfactant, which contain components to lower the surface tension of water.

(1) Flow Path Configuration

Figure 9:
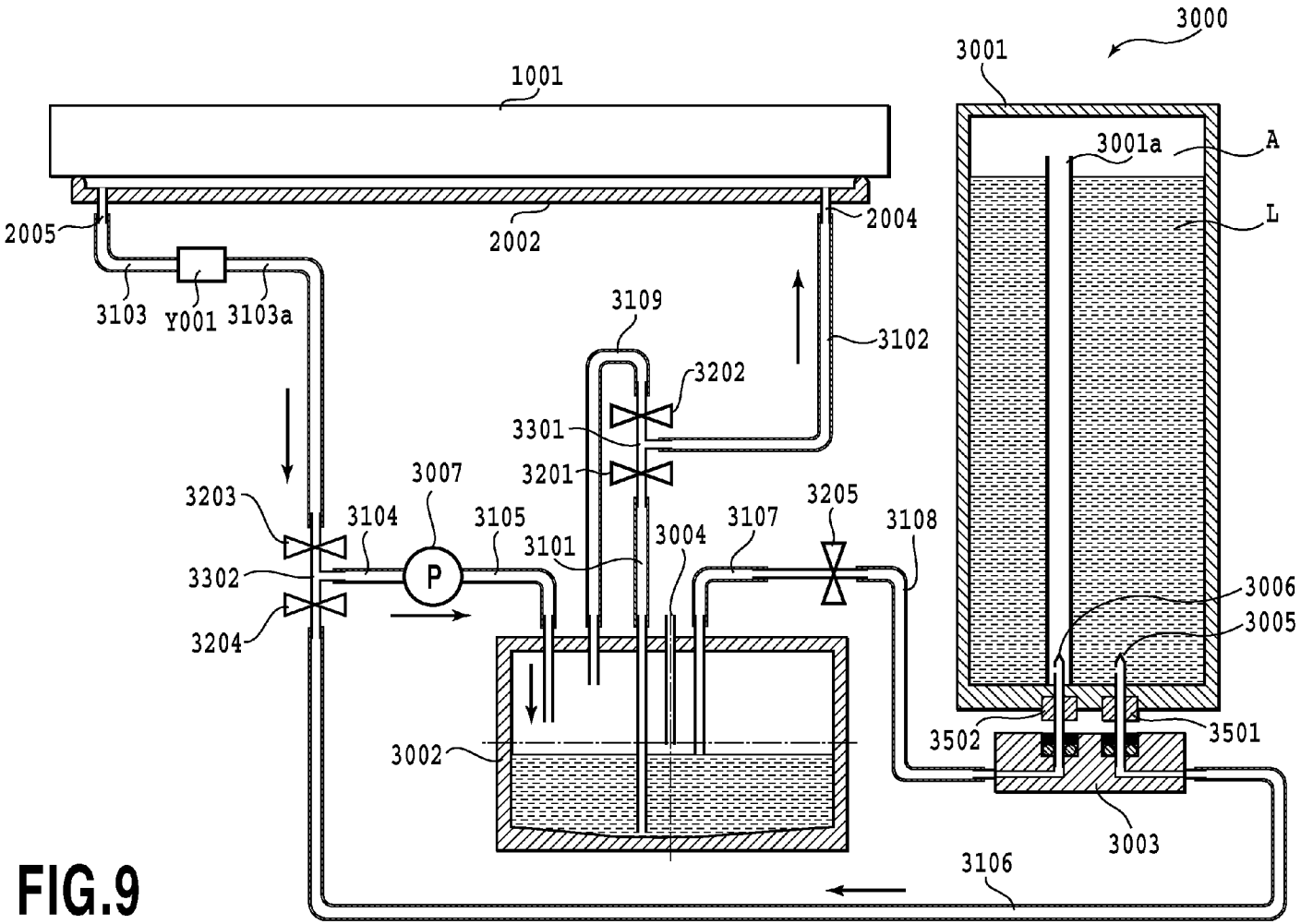
FIG. 9 is an explanatory view showing a schematic configuration of a liquid flow path of the first embodiment of the present invention.

FIG. 9 is an explanatory view showing a schematic configuration of the liquid flow path 3000 to be coupled to the liquid holding member 2001 of the application liquid supplying unit of the present embodiment. The liquid flow path 3000 has a tube 3101 and a tube 3102 included in a first flow path (supply flow path) that couples the liquid supply port 2004 of the space forming base material 2002 and a buffer tank 3002 for storing the application liquid. Moreover, the liquid flow path 3000 has tubes 3103, 3103*a*, 3104, and 3105 included in a second flow path (recovery flow path) that couples the liquid recovery port 2005 of the space forming base material 2002 and the buffer tank 3002. To determine whether the application liquid exists in the space forming base material 2002, provided between the tubes 3103 and 3103*a* being in the middle of the second flow path is a liquid detection sensor Y001, which is an electrical detection unit. Moreover, in the buffer tank 3002, an atmospheric air communication port 3004 is provided.

Figure 10:
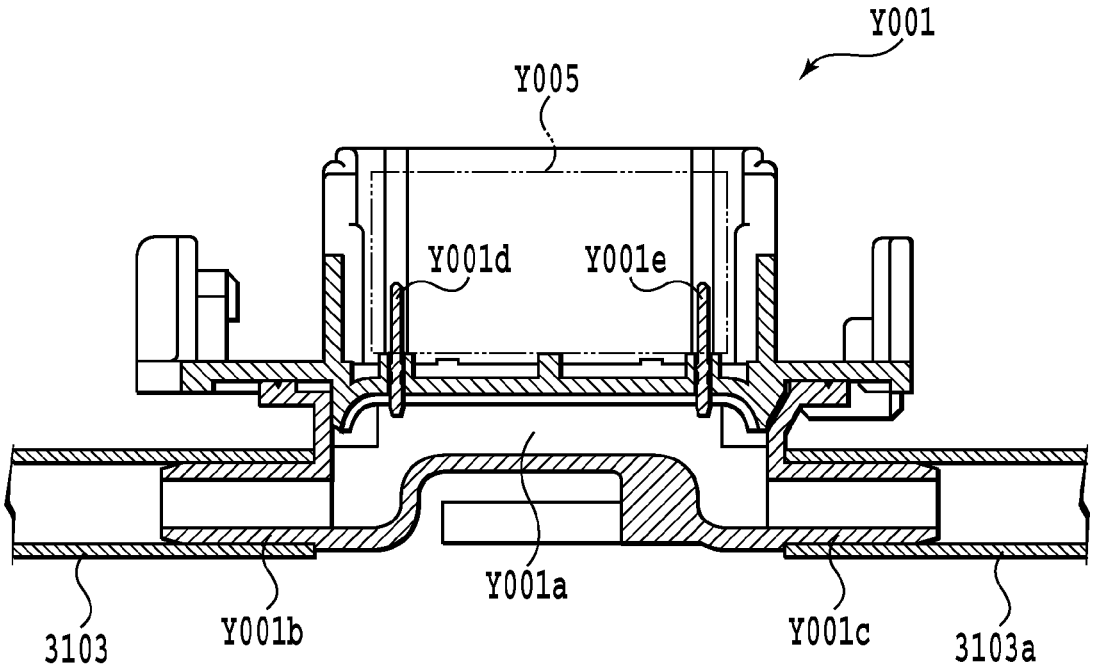
FIG. 10 is a schematic sectional view showing a liquid detection sensor of the first embodiment of the present invention.

FIG. 10 is a schematic sectional view showing the liquid detection sensor Y001. Joint portions Y001*b* and Y001*c* of the liquid detection sensor Y001 are connected with the tubes 3103 and 3103*a*. Moreover, a hermetically sealed flow path Y001*a* is formed inside, and electrode members Y001*d* and Y001*e* formed of a metal are protruded into the flow path Y001*a*. The electrode members Y001*d* and Y001*e* are connected with a connector Y005, and the connector Y005 is connected to an unillustrated detection circuit by a connecting unit. In addition, the detection circuit is connected to a control section 4000. The liquid detection sensor Y001 and detection circuit supply electricity to the electrode members Y001*d* and Y001*e* to thereby determine whether the application liquid exists in the flow path Y001*a*.

The tube 3101 and the tube 3102 that form the first flow path are provided with a first T-shaped flow path 3301 that couples three ports. The first T-shaped flow path 3301 is coupled with the buffer tank 3002 by the tube 3101. Further, a shutoff value 3201 that enables switching between communication and shutoff is provided at the side of a coupling port to be coupled with the tube 3101 further than a junction that couples the three ports. Moreover, the first T-shaped flow path 3301 couples another coupling port with a tube 3109. The tube 3109 is coupled to the buffer tank 3002 to communicate with the atmospheric air via the buffer tank 3002 and the atmospheric air communication port 3004.

Moreover, at the tube 3109 side of the first T-shaped flow path 3301, a shutoff value 3202 that enables switching between communication and shutoff is provided. Further, the first T-shaped flow path 3301 couples the other coupling port with the liquid supply port 2004 by the tube 3102. This structure of the first shutoff valve 3201, the second shutoff valve 3202, and the first T-shaped flow path 3301 makes it possible to select, by combination of communication and shutoff of the two shutoff valves, a coupling counterpart of the tube 3102 from the atmospheric air and the application liquid stored in the buffer tank 3002.

Further, in the second flow path, the tubes 3103, 3103*a*, 3104, and 3105, the liquid detection sensor Y001, and a pump 3007 to make the application liquid and air flow by force in the direction of the buffer tank 3002 within the present liquid flow path 3000 are arranged. Of the pump 3007, at a side where the application liquid flows in (hereinafter, referred to also as an "upstream side of the pump"), the tube 3104 is coupled. On the other hand, at a side of the pump 3007 where the application liquid flows out (hereinafter, referred to also as a "downstream side of the pump"), the tube 3105 is coupled. This tube 3105 couples the buffer tank 3002 and the pump 3007.

Coupling, the buffer tank 3002 and the space forming base material 2002 by these first and second flow paths and driving the pump 3007 allows supplying while circulating the application liquid in the buffer tank 3002 to the space forming base material 2002.

The liquid flow path 3000 further has a third flow path (replenishment flow path) that couples a replaceable replacement tank 3001 for storing the application liquid and the second flow path and a fourth flow path that couples the buffer tank 3002 and the replacement tank 3001. Also, the replacement tank 3001 is a tank having a larger capacity than that of the buffer tank 3002.

A tube 3106 included in the third flow path couples with the replacement tank 3001 via an injection needle-shaped first coupling port 3005 and a mount 3003 that forms a coupling flow path. More specifically, as a result of the injection needle-shaped first coupling port 3005 passing through a rubber 3501 provided at the bottom portion of the replacement tank 3001, the tube 3106 is coupled with the replacement tank 3001. The other port of the tube 3106 couples with a second T-shaped flow path 3302. In the present embodiment, the tube 3106 serves as a replenishment flow path to supply the application liquid from the replacement tank 3001 to the buffer tank 3002.

Moreover, the third flow path and the fourth flow path are formed of a material having not only a high water vapor barrier property but also flexibility, which is, for example, high-density polyethylene. This allows suppressing evaporation of the application liquid in the flow path to the minimum and improving assemblability of a printing apparatus loaded with the present circulating section.

The above-mentioned second T-shaped flow path 3302 includes, at the side of a coupling port to be coupled with the tube 3103*a* further than a junction that couples three ports, a third shutoff valve 3203 that enables switching between communication and shutoff of the tube 3103*a* and the second T-shaped flow path 3302. The second T-shaped flow path 3302 also includes, at the side of a coupling port to be coupled with the tube 3106 further than the junction, a fourth shutoff valve 3204 that enables switching between communication and shutoff of the tube 3106 and the second T-shaped flow path 3302.

This structure of the third shutoff valve 3203, the fourth shutoff valve 3204, and the second T-shaped flow path 3302 makes it possible to select, by combination of communication and shutoff of the two shutoff valves, a coupling counterpart of the tube 3104 from the replacement tank 3001 and the space forming base material 2002.

The fourth flow path includes tubes 3107 and 3108. The tube 3108 included in the fourth flow path couples with the replacement tank 3001 via an injection needle-shaped second coupling port 3006 and the mount 3003 that forms a coupling flow path. More specifically, as a result of the injection needle-shaped second coupling port 3006 passing through a rubber 3502 provided at the bottom portion of the replacement tank 3001, the tube 3108 is coupled with the replacement tank 3001. The replacement tank 3001 communicates with the buffer tank 3002 via a fifth shutoff valve 3205 that enables switching between communication and shutoff of the tube 3107 and the tube 3108.

Moreover, in the replacement tank 3001, an atmospheric air communication pipe 3001*a* is provided. The atmospheric air communication pipe 3001*a* is connected at its lower end to the second coupling port 3006, and the upper end is protruded into an air layer A of the replacement tank 3001. Such a construction allows, when the fifth shutoff valve 3205 is opened, to balance the internal pressure of the replacement tank 3001 with the open air without making an application liquid L in the replacement tank 3001 flow out to a circulation route. Providing the fourth flow path makes it unnecessary to provide an atmospheric air communication port in the replacement tank 3001. Moreover, providing the fourth flow path allows performing circulating replenishment when replenishing the buffer tank 3002 with the application liquid from the replacement tank 3001. When the application liquid remains in the buffer tank 3002 at the time of replenishment of the buffer tank 3002 with the application liquid, the remaining application liquid may be increased in viscosity due to evaporation etc. However, according to the present embodiment, the application liquid supplied to the buffer tank 3002 and the remaining application liquid dissolve into each other, and further, the mutually dissolved application liquid is sent to the replacement tank 3001 due to circulating replenishment. Accordingly, influence of evaporation in the buffer tank on the application liquid can be further reduced.

Moreover, in the present embodiment, the coupling ports into the replacement tank 3001 are formed in injection needle shapes, and the bottom portion of the replacement tank 3001 is sealed by the rubber, and thus evaporation of the application liquid in the replacement tank when the replacement tank has not been mounted can be suppressed.

Also, switching of each shutoff valve is performed by a control signal from the control section, whereby filling, supply, recovery, or the like of the application liquid is performed. Details of a concrete operation will be described later.

In the present embodiment, at the upstream side of the pump 3007, the recovery flow path and the replenishment flow path are joined, and performed is switching of coupling of the flow path leading to the pump 3007 with the recovery flow path and replenishment flow path. When the recovery flow path and the pump 3007 are coupled at the switching time, the replenishment flow path and the pump 3007 are not coupled. Accordingly, at this time, circulation of the application liquid and supply and recovery of the application liquid for the liquid holding space S can be performed, by the pump 3007, in the first flow path, the liquid holding space S, and the second flow path. On the other hand, when the replenishment flow path and the pump 3007 are coupled by switching, the recovery circuit and the pump 3007 are not coupled. Accordingly, at this time, via the third flow path, the buffer tank 3002 can be replenished with the application liquid from the replacement tank 3001.

As above, in the present embodiment, at the upstream side of the pump 3007, joining of the recovery flow path and the replenishment flow path and switching of these flow paths are performed, and either flow path not communicated with the pump 3007 is shut off from the pump 3007. Therefore, it becomes possible to perform control of the flow path having the buffer tank 3002 and the replacement tank 3001 by the single pump. More specifically, even when a buffer tank and a replacement tank are simultaneously arranged in an identical apparatus, it is not necessary to increase the number of pumps. Accordingly, since there is no need to add to the flow path and control section with an increase in the number of pumps, an increase in the number of components can be suppressed including the pump, which does not cause an increase in the size of the apparatus, and also leads to a reduction in cost.

Moreover, in the present embodiment, if the buffer tank 3002 and the replacement tank 3001 are provided in an identical apparatus, one pump is sufficient. Accordingly, even when a buffer tank is provided for the purpose of head differential control, members necessary for liquid application can be housed in an identical liquid application apparatus.

Further, in the present embodiment, since the application liquid is circulating through the first flow path, the liquid holding space S, the second flow path, and the buffer tank 3002 during an applying operation, dust clogging in the injection needle-shaped coupling port due to dust and paper powder, etc., mixed at the time of the applying operation can be avoided.

For realizing stabilization in the application amount of an application liquid onto the application roller 1001 from the liquid holding space S, it is desirable, even if an application liquid in a storage tank is consumed, to suppress fluctuation in head differential between the liquid level of the application liquid in the storage tank and the liquid holding space S. For suppressing such fluctuation in head differential resulting from consumption of the application liquid in the storage tank, it suffices to provide the storage tank with a small height. However, when considering the fact that the larger the amount of the application liquid that can be stored in the storage tank, the more preferable, for storing a larger amount of application liquid in the storage tank with a small height, the area of the bottom face thereof must be enlarged. This results in an increase in the size of the apparatus. Therefore, in the present embodiment, the replacement tank 3001 and the buffer tank 3002, which are different in roles, are used. More specifically, the buffer tank 3002 having a smaller capacity than that of the replacement tank 3001 and having a smaller height than that of, at least, the replacement tank 3001 is used to perform circulation, filling, and recovery of the application liquid for the liquid holding space S. Moreover, in the identical apparatus, a large amount of application liquid is stored by the replacement tank 3001 having a larger capacity than that of the buffer tank 3002. Since the capacity of the buffer tank 3002 is smaller than that of the replacement tank 3001, the time until the application liquid is used up is also quicker, however, replenishment of the buffer tank 3002 with the application liquid is performed as needed from the replacement tank 3001. As such, while setting the amount of the application liquid that can be stored in the apparatus large, the height of the storage tank (buffer tank) relating to filling, recovery, and circulation of the application liquid for the liquid holding space S can be reduced. As a result, even when the application liquid in the buffer tank 3002 is consumed, fluctuation in head differential between the liquid level of the application liquid in the buffer tank 3002 and the liquid holding space S can be suppressed. As a result, it becomes possible to stabilize the application amount of the application liquid by the application roller 1001.

Moreover, by suppressing fluctuation in head differential, wear of the application roller 1001 and the abutting member 2009 can be reduced. In the present embodiment, the pump 3007 is provided at a recovery side to the buffer tank 3002, and thus, when circulating the application liquid, the pressure at the liquid recovery port 2005 becomes relatively lower than that at the liquid supply port 2004, so that circulation by a decompression system is achieved. Accordingly, a negative pressure is generated in the liquid holding space S, and the negative pressure is increased as the head differential is increased. In the present embodiment, although the abutting member 2009 is pressed against the application roller 1001 by spring urging of the spring member 2006, because of an increase in negative pressure due to an increase in head differential, the pressing force is also increased. Due to the increase in pressing force, wear of an abutting portion between the application roller 1001 and the abutting member 2009 is also increased. However, in the present embodiment, since fluctuation in head differential can be suppressed, wear can be reduced, so that it becomes possible to improve durability of the application roller 1001 and the abutting member 2009.

(2) Control System

Figure 11:
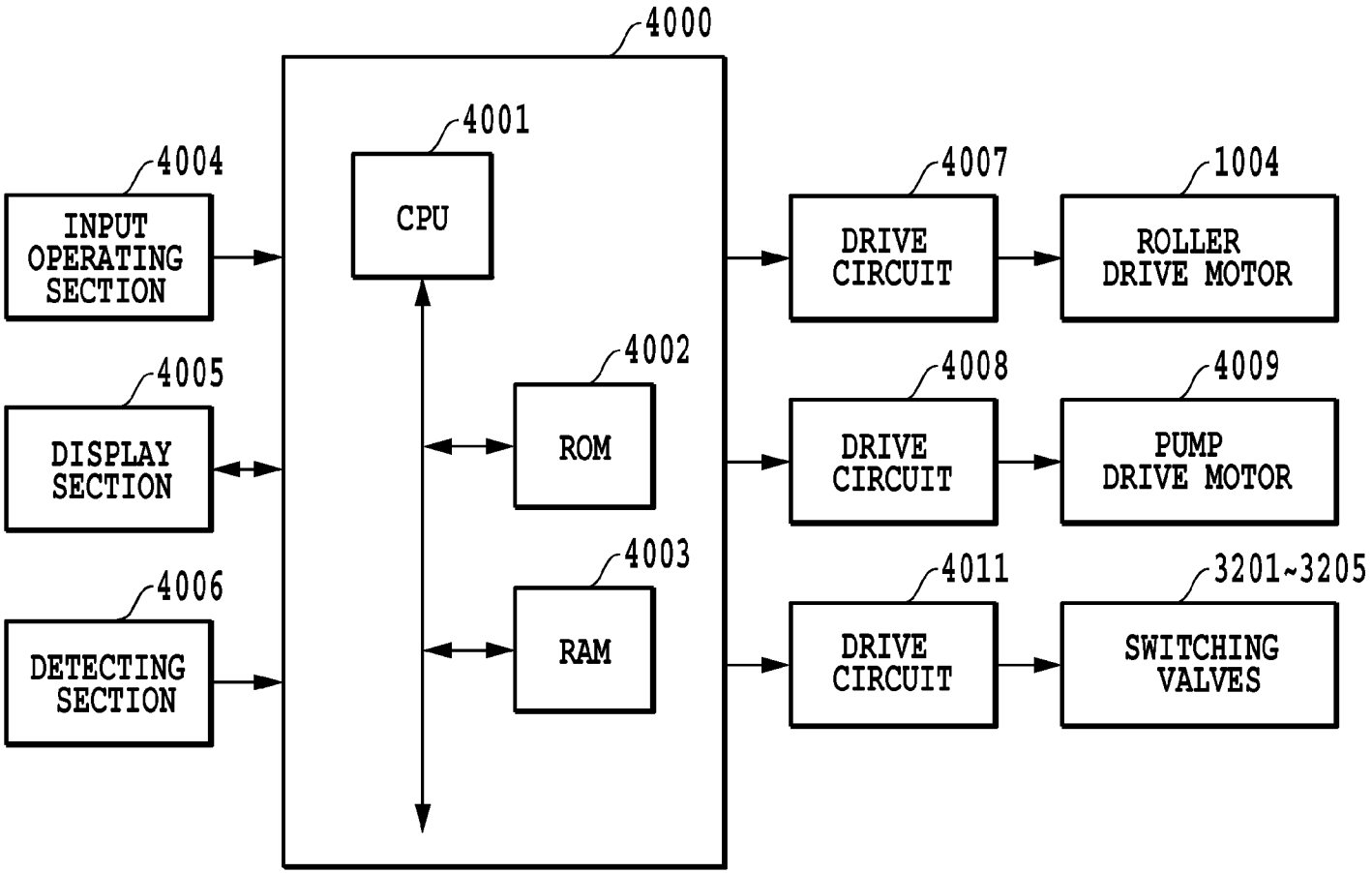
FIG. 11 is a block diagram showing a schematic configuration of a control system in a liquid application apparatus of the first embodiment of the present invention.

FIG. 11 is a block diagram showing a schematic configuration of a control system in a liquid application apparatus of the present embodiment. In FIG. 11, the control section 4000 is a control unit that controls the entire liquid application apparatus. The control section 4000 also has a CPU 4001 that executes various processing operations such as computing, control, and determination. The control section 4000 also has a ROM 4002 that stores a control program and the like such as a processing to be executed by the CPU 4001 to be described later in FIG. 12, a RAM 4003 that temporarily stores data during a processing operation by the CPU 4001 and input data, and the like.

The control section 4000 is connected with an input operating section 4004 including a keyboard to input a predetermined command or data or the like or various types of switches and a display section 4005 that performs various displays including an input/setting state of the liquid application apparatus. Also, the control section 4000 is connected with a detecting section 4006 including a sensor for detecting a position of the applied medium and an operation state of each section. The aforementioned liquid detection sensor Y001 is a part of the detecting section 4006. Further, the control section 4000 is connected with the roller drive motor 1004, a pump drive motor 4009, and first to fifth switching valves 3201 to 3205 via drive circuits 4007, 4008, and 4011, respectively.

(3) Liquid Applying Operation Sequence

Figure 12:
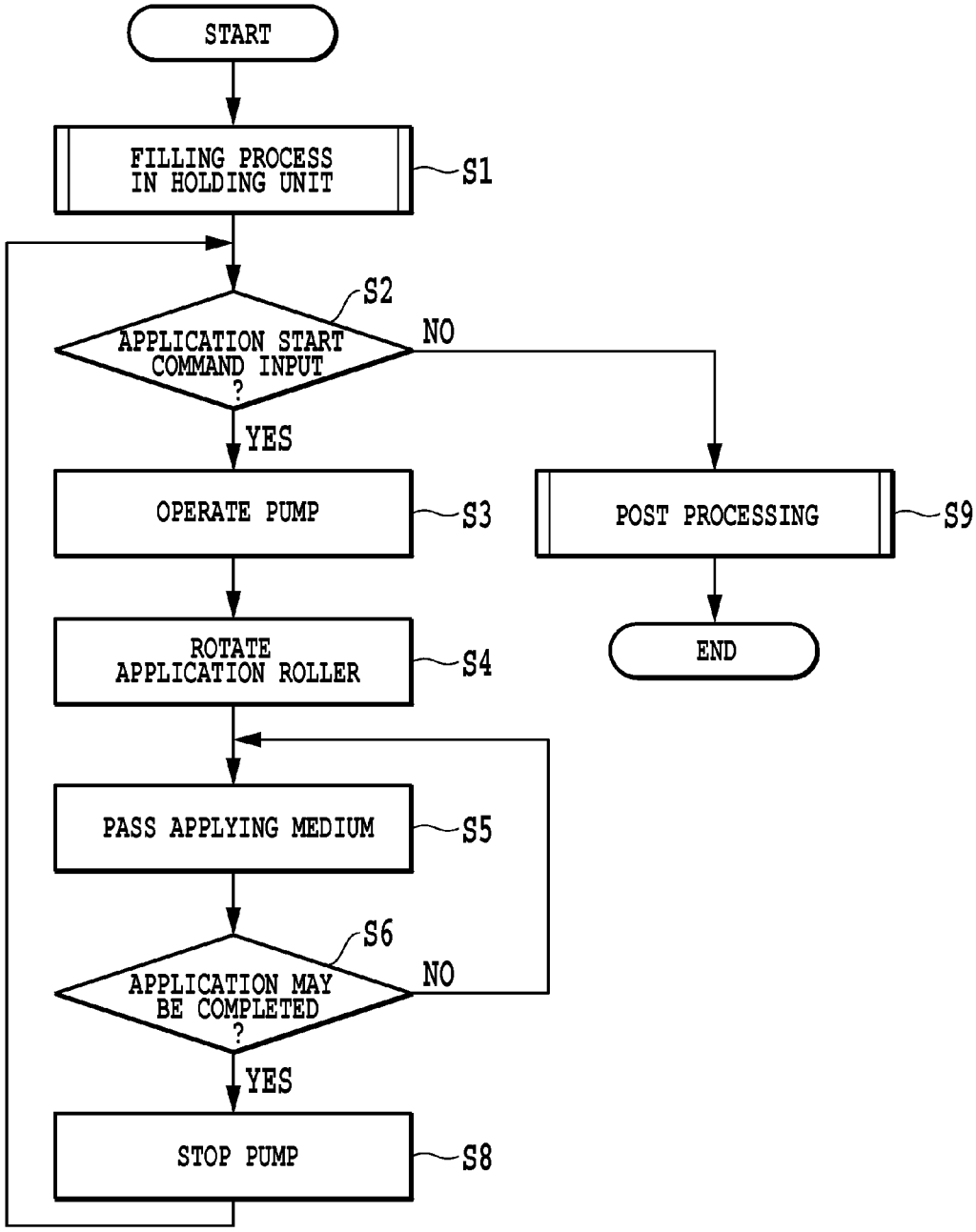
FIG. 12 is a flowchart showing a processing procedure for liquid application in the liquid application apparatus of the first embodiment of the present invention.

FIG. 12 is a flowchart showing a processing procedure for liquid application in the liquid application apparatus of the present embodiment. When the liquid application apparatus is powered on, the control section 4000 executes an applying operation sequence according to the flowchart shown in FIG. 12. Hereinafter, each step relating to liquid application will be described with reference to the flowchart.

The combinations of opening and closing of the respective shutoff valves are provided as four combinations of "standing," "replenishment," "circulation," and "recovery." The control section 4000 selects a combination appropriate for the state of the apparatus, and sends a control signal to each shutoff valve so as to operate according to the selected combination.

TABLE 1

| | $1^{st}$ shutoff valve | $2^{nd}$ shutoff valve | $3^{rd}$ shutoff valve | $4^{th}$ shutoff valve | $5^{th}$ shutoff valve |
|---|---|---|---|---|---|
| Standing | Close | Open | Close | Close | Close |
| Replenishment | Close | Close | Close | Open | Open |
| Circulation | Open | Close | Open | Close | Close |
| Recovery | Close | Open | Open | Close | Close |

Here, the "standing" means a state of the respective shutoff valves, during a non-operation time, where the application liquid has been recovered from the liquid holding space S. The "replenishment" means a state of the respective shutoff valves when replenishing the buffer tank 3002 with the application liquid from the replacement tank 3001. The "circulation" means a state of the respective shutoff valves when circulating the application liquid in the buffer tank 3002, the first flow path, the liquid holding space S, and the second flowpath. The "recovery" means a state of the respective shutoff valves when recovering the application liquid from the liquid holding space S into the buffer tank 3002.

Moreover, as the state of the "standing," it is also possible to switch the second shutoff valve into a "close" state. In this case, since the liquid holding space S and the buffer tank 3002 are completely shut off, in any situation of the non-operation time, the application liquid in the buffer tank 3002 no longer intrudes into the liquid holding space S.

(3-1) Filling Process

Figure 13:
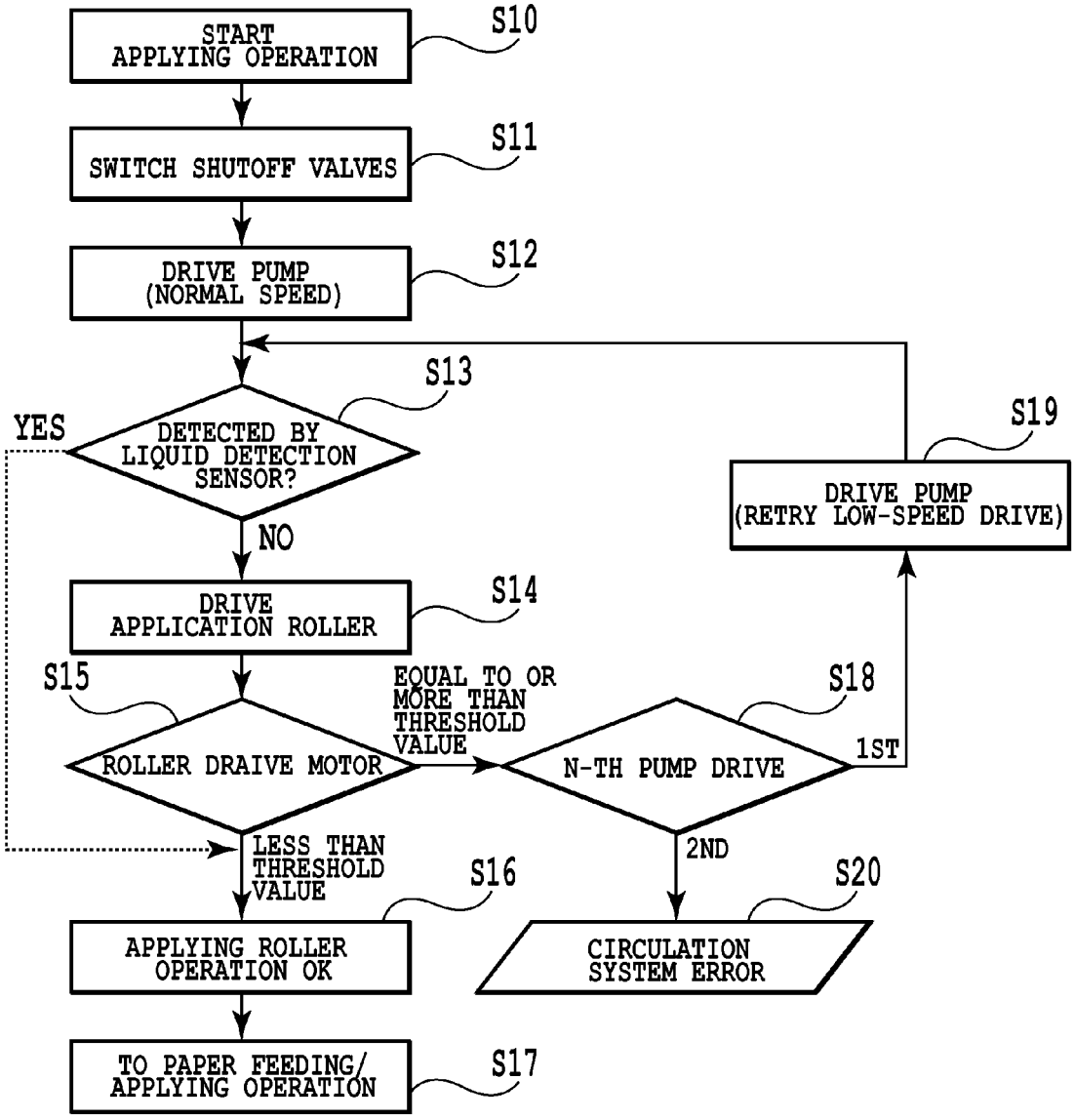
FIG. 13 is a flowchart showing details of operation of a filling process of the first embodiment of the present invention.

FIG. 13 is a flowchart showing details of operation of a filling process of the application liquid into the holding space S in step S1 of FIG. 12. In the filling process, when an applying operation is started (step S10), the respective shutoff valves are switched to be an opening and closing combination of "circulation" (step S11). This opening and closing combination allows the buffer tank 3002 to communicate with the liquid holding space S through the first flow path and the second flow path.

Thereafter, while whether the liquid exists is monitored by the liquid detection sensor Y001, the pump 3007 is driven at a normal speed (step S12). By driving the pump 3007, the application liquid is supplied to the first flow path, the liquid holding space S, the tube 3103, and the liquid detection sensor Y001, in order. Then, when the flow path Y001*a* of the liquid detection sensor Y001 is filled with the application liquid, it is judged whether a state where the liquid is present has been detected by the liquid detection sensor Y001 (step S13). If the liquid is detected by the liquid detection sensor Y001, driving of the pump 3007 is stopped. In this case, since the application liquid has been supplied to the application roller 1001, application onto an applied medium becomes possible (step S16), and an applying operation is performed (step S17).

On the other hand, if a state where the liquid is present has not been detected by the liquid detection sensor Y001, the application roller is driven (step S14). More specifically, even when the pump 3007 is driven by a sufficient amount for filling the liquid detection sensor Y001 with the liquid, the liquid detection sensor Y001 may not be able to detect the presence of the liquid. The reason is, for example, a defect in the pump or circulation route. As another reason, the application liquid is increased in viscosity in the pump to reach a high viscous resistance, so that the pump does not normally function at a normal pump speed. As still another reason, the application liquid has been increased in viscosity in the circulation route, and the flow rate has been decreased. As a further reason, even when there is the application liquid in the flow path Y001*a* of the liquid detection sensor Y001, it is not detected that the liquid is present.

As above, when a state where the liquid is present has not been detected by the liquid detection sensor Y001 even when the pump 3007 is driven by a sufficient amount (step S13), the roller drive motor 1004 is driven to rotate the application roller 1001 (step S14). A drive load at this time is detected from a drive current of the roller drive motor 1004 or a PWM duty, etc. (step S15). If the load is less than a threshold value, it is judged that the application liquid exists in the liquid holding space S (step S16), and a subsequent applying operation is performed (step S17).

If the load is equal to or more than the threshold value (step S15), it is judged that the application liquid does not exist in the liquid holding space S, and the pump 3007 is again driven at a low speed so as to fill the application liquid (step S19). As a result, if the liquid detection sensor Y001 detects the presence of the application liquid, it is judged that the application liquid exists in the liquid holding space S (step S13, S16), and the process proceeds to a subsequent applying operation (step S17).

If a state where the liquid is present has not been detected by the liquid detection sensor Y001 even when driving of the pump 3007 is retried, the application roller 1001 is again driven (step S14), and a drive load of the roller drive motor 1004 is detected (step S15). If the drive load is less than the threshold value, it is judged that the application liquid exists in the liquid holding space S (step S16), and a subsequent applying operation is performed (step S17). On the other hand, if the drive load is again equal to or more than the threshold value, it is judged that some abnormality has occurred in the pump 3007 or the liquid flow path 3000, and a circulation system error is output through step S18 (step S20).

Also, in the present embodiment, when retrying driving of the pump 3007 in step S19, driving speed of the pump is changed. However, driving of the pump of the present invention may be retried at the same speed as that of driving of the pump 3007 in step S12. For example, when the driving speed is accelerated, a larger negative pressure can be generated by the pump, so that the flow velocity that has been decreased due to an increase in viscosity of the liquid can be increased. When the driving speed is decelerated, the pump can be almost normally functioned even when the application liquid has been increased in viscosity in the pump.

Alternatively, for driving of the roller drive motor 1004 in step S14, a preliminary operation for performing a conveying operation of a printing sheet can be used. The preliminary operation is, for example, an operation for removing a fixedly adhered liquid to be described later. This makes it unnecessary to add a new operation for detecting whether the application liquid exists in the liquid holding space S, which leads to a reduction in operating time.

(3-2) Replenishing Process

In step S1 of FIG. 12, when it is judged by a sensor or the like serving as a liquid level management unit for detecting the height of a liquid level in the liquid holding member that the filling of the application liquid in the buffer tank 3002 is insufficient, the respective shutoff valves are switched to be an opening and closing combination of "replenishment." Thereafter, the pump 3007 is driven for a certain period of time. This opening and closing combination allows the buffer tank 3002 to communicate with the replacement tank 3001 through the third flow path and the fourth flow path. Thereby, the buffer tank 3002 is replenished with the application liquid.

Figure 14:
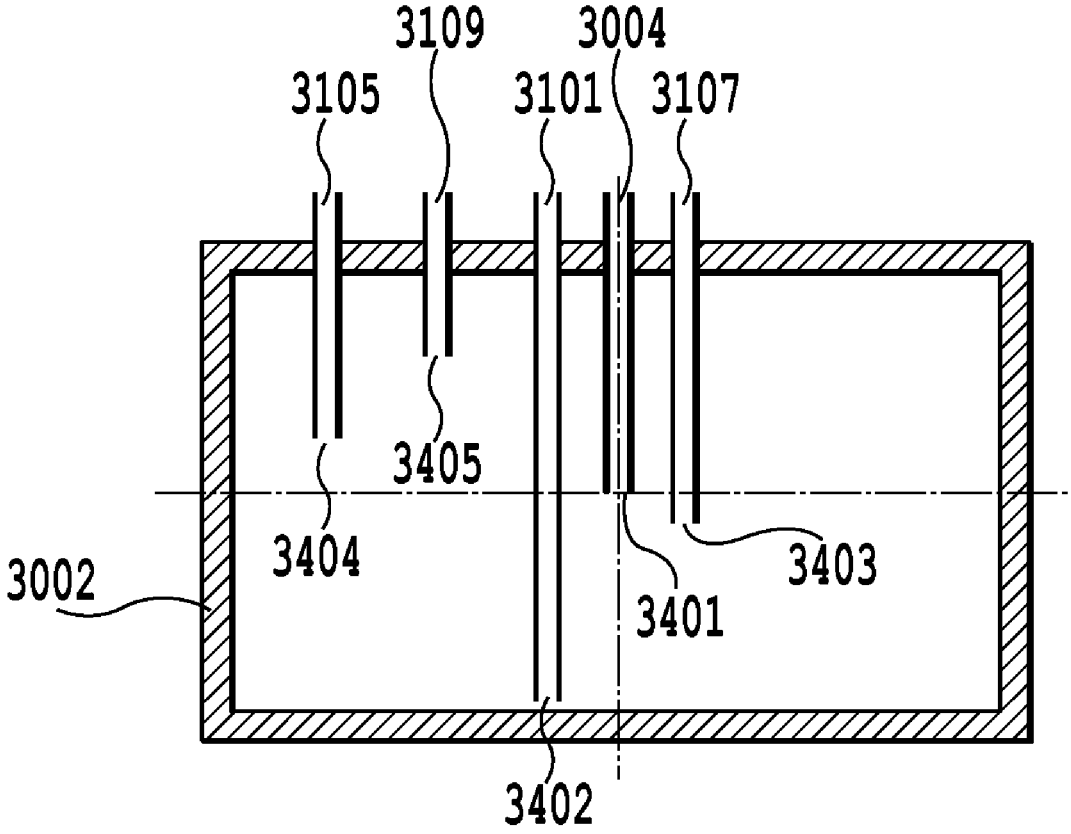
FIG. 14 is a schematic view showing a construction of a buffer tank of the first embodiment of the present invention.
Figure 15:
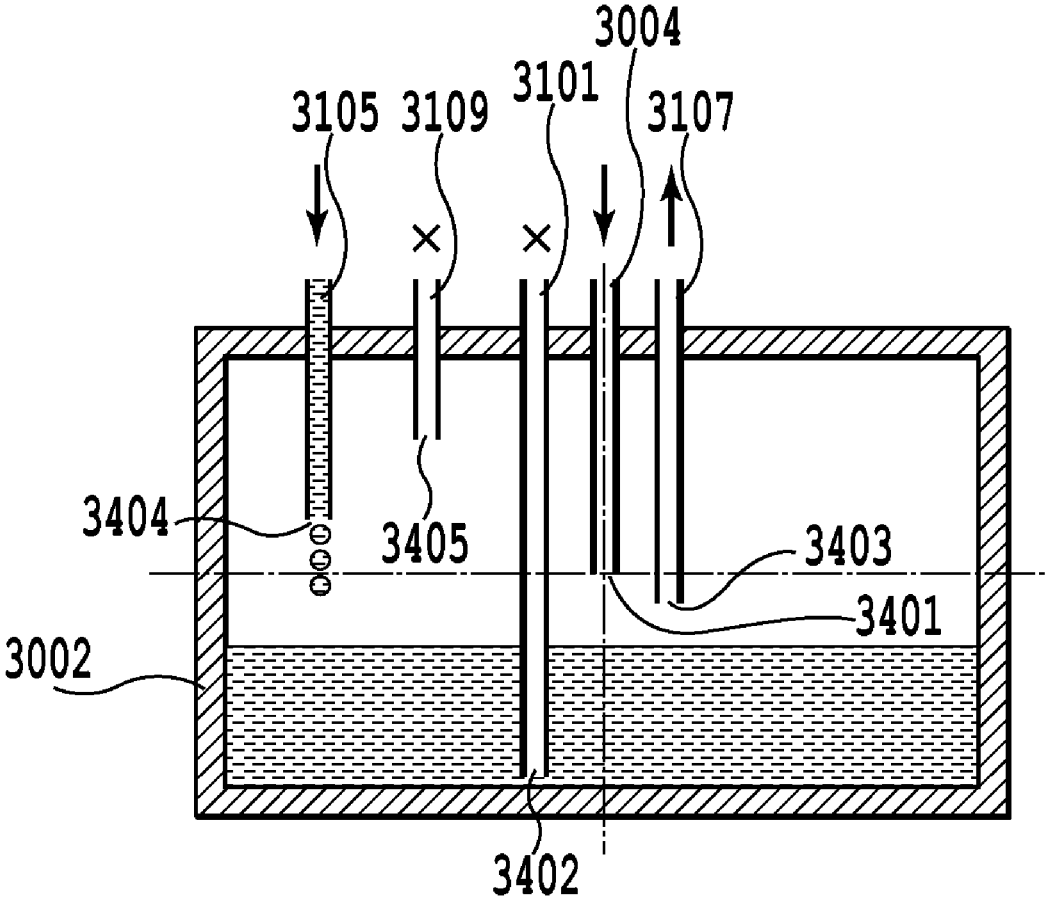
FIG. 15 is a schematic view showing a configuration of the buffer tank of the first embodiment of the present invention.
Figure 16:
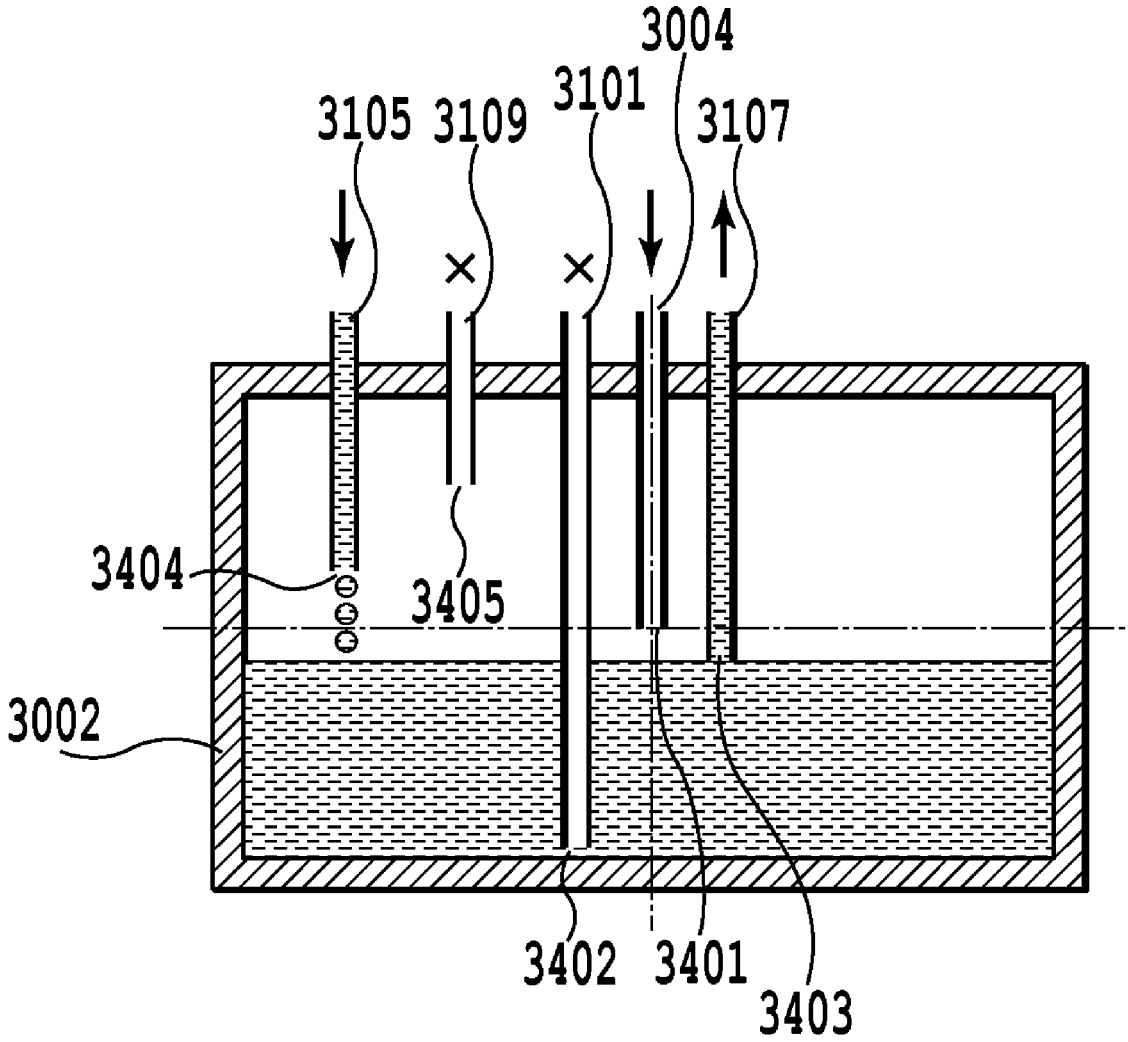
FIG. 16 is a schematic view showing a configuration of the buffer tank of the first embodiment of the present invention.

FIG. 14, FIG. 15, and FIG. 16 are schematic views showing a construction of the buffer tank 3002 of the present embodiment. The space in the interior of the buffer tank in the present embodiment is provided as a rectangular parallelepiped in consideration of convenience of description.

In FIG. 14, the interior of the buffer tank 3002 and a flow path that couples to the supply flow path 3101 are communicated at an opening portion 3402. The interior of the buffer tank 3002 and a flow path that couples to the recovery flow path 3105 are communicated at an opening portion 3404. The interior of the buffer tank 3002 and a flow path that couples to the tube 3109 are communicated at an opening portion 3405. An opening portion 3403 is communicated with the tube 3107 being the fourth flowpath communicated with the replacement tank 3001. An opening portion 3401 is communicated with the atmospheric air communication port 3004.

The opening portion 3404 is not restricted in position in the vertical direction. The position in the vertical direction of the opening portion 3404 of the present embodiment is provided as a position shown in FIG. 14 for the sake of convenience of description. The opening portion 3402 is provided at a position close to the bottom face of the buffer tank 3002 so that the application liquid in the buffer tank 3002 can be used as effectively as possible. The opening portion 3405 needs to be communicated with the atmospheric air in a recovery operation, and must be communicated with the atmospheric air communication port 3004 by way of the interior of the buffer tank 3002. Accordingly, the position in the vertical direction of the opening portion 3405 is provided as a position close to the ceiling of the buffer tank 3002. However, in a replenishing operation, since the flow paths communicated with the opening portion 3402 and the opening portion 3405 have been shut off by the respective valves, the structure is equivalent to one having no opening portions. The opening portion 3401 is provided at as close a position as possible to the center of the interior space of the buffer tank 3002. Here, a center of gravity when the shape of the interior space of the buffer tank 3002 is formed of a uniform substance is defined as a center of the interior space of the buffer tank 3002. The position in the vertical direction of the opening portion 3403 is provided as a position lower than the position of the opening portion 3401.

As shown in FIG. 15 and FIG. 16, the filling is performed up to the water level of the opening portion 3403 being an end portion of the fourth flow path located in the interior of the buffer tank 3002. When the application liquid is filled up to the water level of the end portion 3403 of the fourth flow path, a flow of circulation occurs between the replacement tank and the buffer tank 3002, and the water level in the buffer tank 3002 does not change. As a result of arranging the end portion 3403 of the fourth flow path at a position lower in the direction of gravity than the opening portion 3401 being an atmospheric air communication port of the buffer tank, the application liquid never flows out from the atmospheric air communication port. According to the present construction, no liquid leakage from the buffer tank 3002 occurs irrespective of the driving time of the pump 3007 in the replenishing process.

Also, as another construction, a sensor for detecting a water level lower in the direction of gravity than the position of the atmospheric air communication port 3401 may be installed in the buffer tank 3002. In this case, the fourth flow path becomes unnecessary. However, in consideration of the case where the sensor for detecting a water level breaks down, both of the fourth flow path and the above-mentioned sensor may be provided.

Also, another water level sensor may be installed at a side closer to the bottom face of the buffer tank than that of the sensor for detecting a water level lower in the direction of gravity than the position of the atmospheric air communication port 3401. In this case, since a state where the amount of liquid in the buffer tank has become small can be detected, it becomes possible to perform a replenishing process using the detection as a trigger.

Moreover, in the present embodiment, the end portion 3402 of the first flow path located in the buffer tank 3002 is located in the vicinity of the bottom portion of the buffer tank 3002. This allows suppressing the mixing of bubbles into the first flow path.

As above, the buffer tank 3002 according to the present embodiment has functions of not only management of the head differential, storage of the liquid, and management of the water level in the tank, but also deaeration.

(3-3) Applying Process

Referring again to FIG. 12, when an application start command is input (step S2), the pump 3007 again starts operating (step S3), and the application roller 1001 starts rotation in the direction of the arrow X shown in FIG. 2 (step S4). Due to the rotation of the application roller 1001, the application liquid L filled in the liquid holding space S slides away between the application roller 1001 and a lower edge portion 2011 of the abutting member 2009 against the pressing force of the abutting member 2009 of the liquid holding member 2001 toward the application roller 1001. The slid-away application liquid adheres to the outer periphery of the application roller 1001 in a layer state. The application liquid L adhered to the application roller 1001 is sent to an abutting portion between the application roller 1001 and the counter roller 1002.

Figure 17:
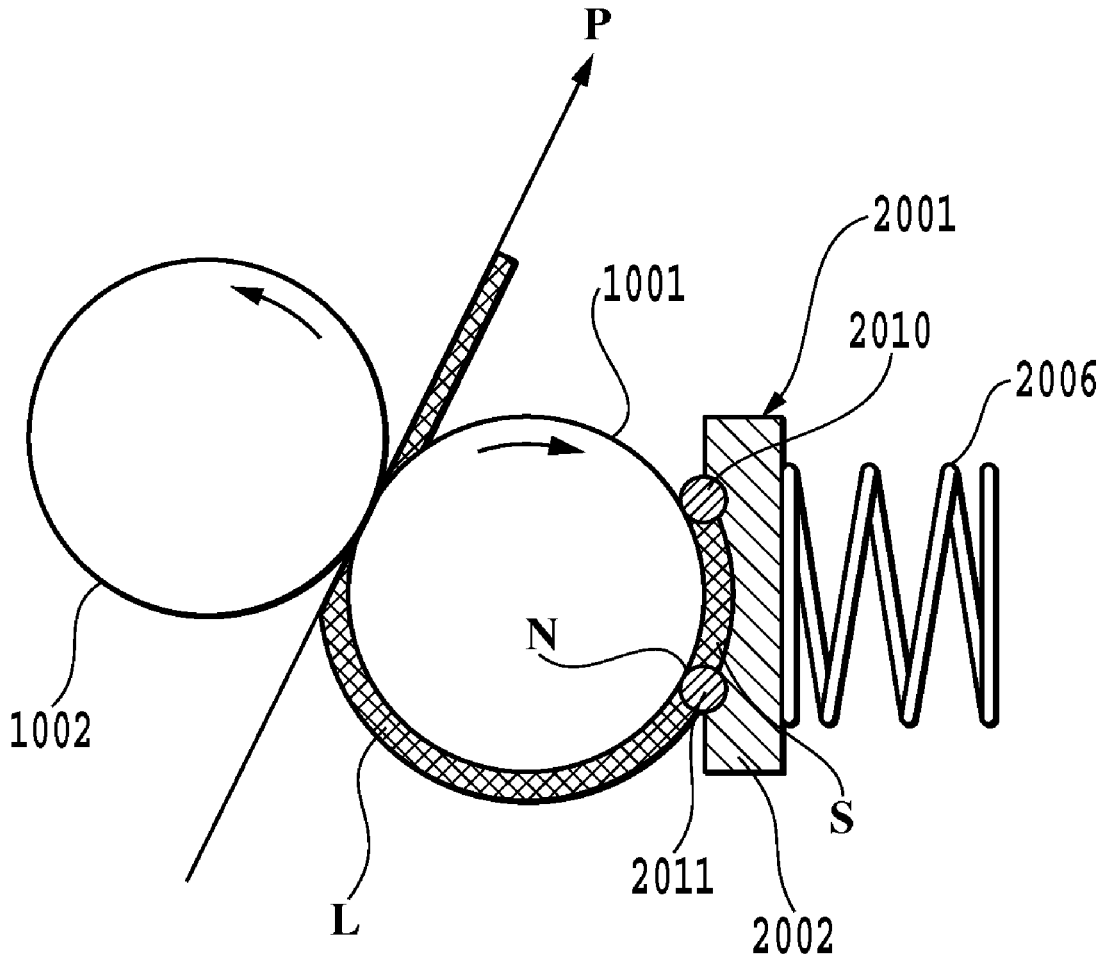
FIG. 17 is a longitudinal sectional view showing a construction of a liquid application unit of the first embodiment of the present invention.

Then, an applied medium P is conveyed to a portion between the application roller 1001 and the counter roller 1002 by an applied medium feed mechanism 1006, and the applied medium P is inserted between these rollers. Concurrently therewith, the applied medium P is conveyed toward a paper discharge section of the application roller 1001 with a rotation of the application roller 1001 and the counter roller 1002 (step S5). In the course of the conveyance, the application liquid L applied to the outer peripheral surface of the application roller 1001 is, as shown in FIG. 17, transferred from the application roller 1001 to the applied medium P. As a matter of course, a unit for supplying the applied medium P between the application roller 1001 and the counter roller 1002 is not limited to the feed mechanism mentioned above. As such a unit, for example, a unit by manual feeding that supplementarily uses a predetermined guide member may be used in combination, and any unit can be used, such as a structure using a manual feeding unit alone.

Figure 18:
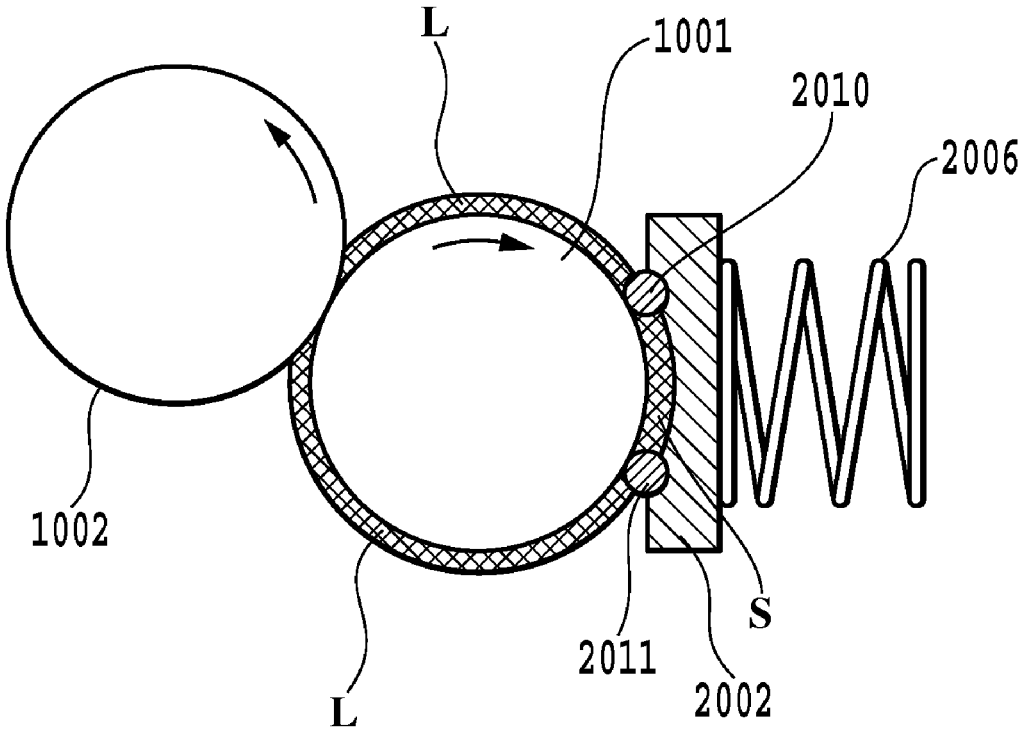
FIG. 18 is a longitudinal sectional view showing a configuration of the liquid application unit of the first embodiment of the present invention.

FIG. 17 and FIG. 18 are longitudinal sectional views showing a construction of the liquid application unit. FIG. 17 shows a state where the application liquid L has been filled in the liquid holding space S formed by the liquid holding member 2001 and the application roller 1001, and the liquid is being applied to the applied medium P due to a rotation of the application roller 1001. Moreover, FIG. 18 shows a state where the application liquid L has been filled in the liquid holding space S formed by the liquid holding member 2001 and the application roller 1001, and the application roller 1001 has been rotated in a state without the applied medium P.

In FIG. 17, a part expressed by crossing oblique lines indicates the application liquid L. Here, the thickness of a layer of the application liquid on the application roller 1001 and the applied medium P is expressed in a considerably exaggerated manner compared to the actual thickness for clearly illustrating the state of the application liquid L when being applied. An applied part of the applied medium P is conveyed in the arrow direction by a conveying force of the application roller 1001. Concurrently therewith, an unapplied part of the applied medium P is conveyed to a contact portion of the applied medium P and the application roller 1001, and the application liquid can be applied over the entire applied medium by performing the operation continuously or intermittently.

FIG. 17 shows an ideal application state where all the application liquid L that has slid away from the lower edge portion 2011 of the abutting member 2009 and adhered to the application roller 2001 has been transferred to the applied medium P. However, in actuality, not all of the application liquid L adhered to the application roller 1001 is transferred to the applied medium P. That is, when the applied medium P to be conveyed is separated from the application roller 1001, the application liquid L often adheres also to the application roller 1001 and remains on the application roller 1001. Although the amount of the application liquid L remaining on the application roller 1001 varies depending on the material of the applied medium P and the state of a minute unevenness of the surface, when the applied medium P is a plain paper, the application liquid L remains on the peripheral surface of the application roller 1001 even after an applying operation.

Figure 19:
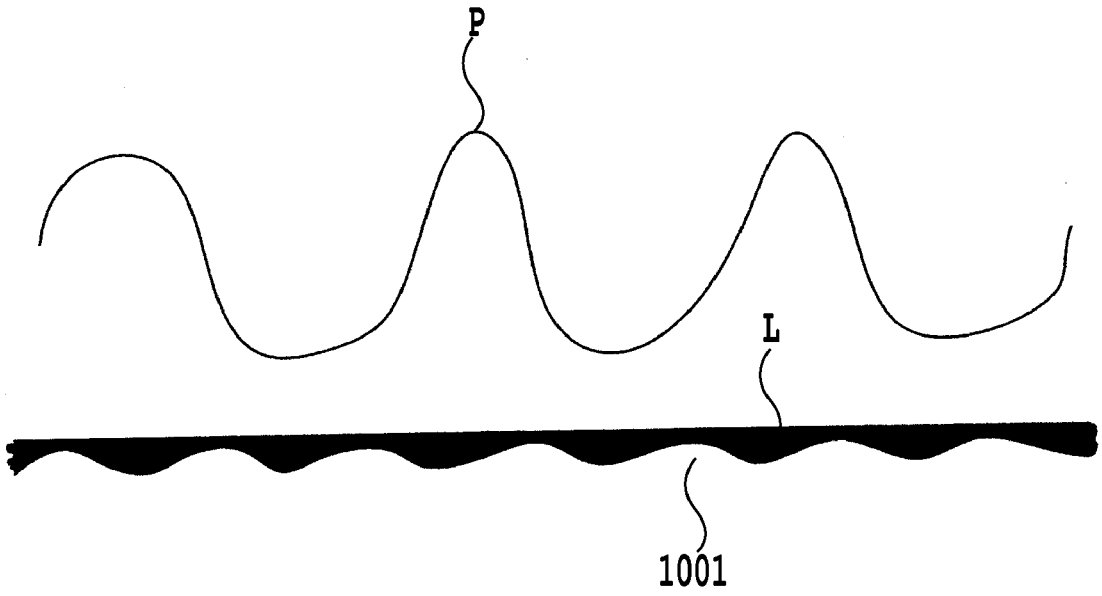
FIG. 19 is an explanatory view for explaining an application process on the surface of a medium and an applied face of the first embodiment of the present invention.
Figure 20:
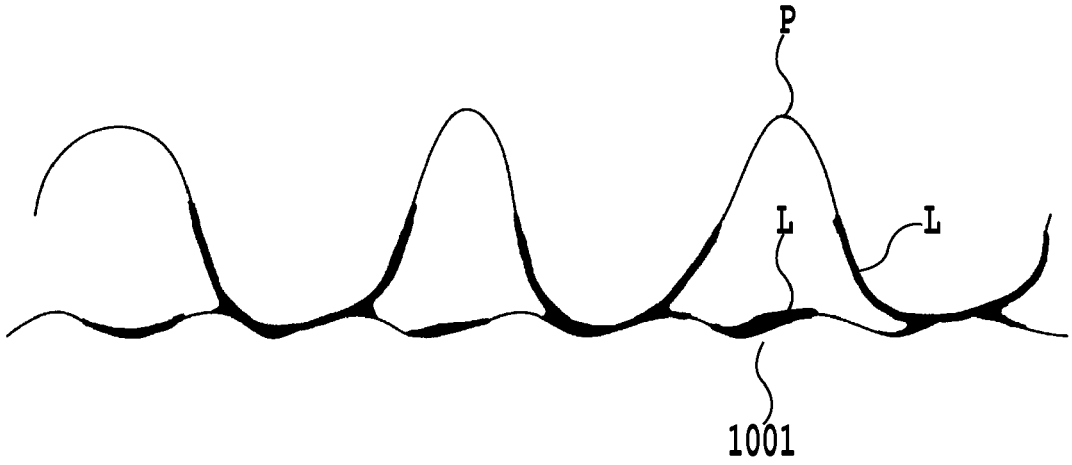
FIG. 20 is an explanatory view for explaining an application process on the surface of a medium and an applied face of the first embodiment of the present invention.
Figure 21:
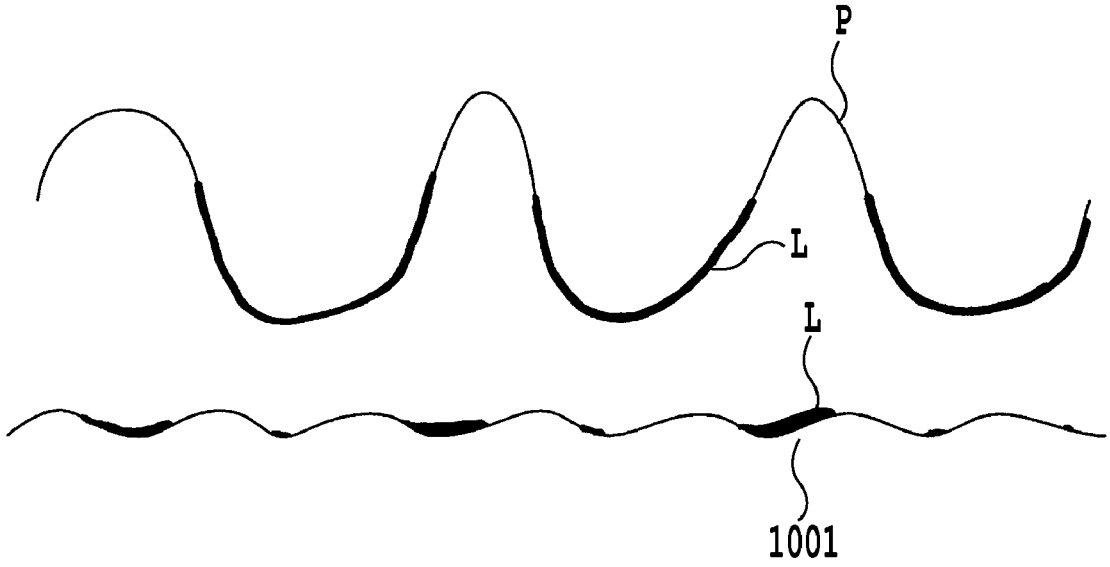
FIG. 21 is an explanatory view for explaining an application process on the surface of a medium and an applied face of the first embodiment of the present invention.

FIG. 19, FIG. 20, and FIG. 21 are explanatory views for explaining an application process on the surface of an applied medium P and an applied face when the medium is a plain paper. Areas blacked out in these figures show a liquid (application liquid L).

FIG. 19 shows a state at an upstream side further than the nip portion between the application roller 1001 and the counter roller 1002. In the same figure, the liquid adheres to the applied face of the application roller 1001 so that the liquid slightly covers the minute unevenness of the surface of the applied face.

FIG. 20 shows a state, at the nip portion between the application roller 1001 and the counter roller 1002, of the surface of a plain paper being the applied medium P and the applied face of the application roller 1001. In the same figure, convexities of the surface of the plain paper contact the applied face of the application roller 1001, and the application liquid L is instantaneously penetrated or adsorbed into fibers of the surface of the plain paper from the contacted part. Moreover, the application liquid L adhered to apart that does not contact the convexities of the surface of the plain paper remains on the applied face of the application roller 1001.

FIG. 21 shows a state at a downstream side further than the nip portion between the application roller 1001 and the counter roller 1002. The same figure is a state where the medium P and the applied face of the application roller 1001 are completely separated. On the applied face of the application roller 1001, the application liquid L remaining in a part that does not contact the convexities of the surface of the plain paper and the application liquid L at the contact portion also remain on the applied face of the application roller 1001, although in trace amounts.

The application liquid L remaining on the application roller 1001, against the pressing force of the abutting member 2009 of the liquid holding member 2001 toward the application roller 1001, slides away between the application roller 1001 and the upper edge portion 2010 of the abutting member 2009 and returns into the liquid holding space S. The application liquid L that has returned into the liquid holding space S is mixed with the application liquid L filled in the same space S.

The returning operation of the application liquid L is similarly performed also when the application roller 1001 is rotated in a state where the applied medium P does not exist as shown in FIG. 18. More specifically, the application liquid L adhered to the outer periphery of the application roller 1001 as a result of rotating the application roller 1001 slides away through a part (nip portion) that abuts against the counter roller 1002. The application liquid L separates into parts on the application roller 1001 and the counter roller 1002, and the application liquid L remains on the application roller 1001. Then, the application liquid L adhered to the application roller 1001 slides away between the upper edge portion 2010 of the abutting member 2009 and the application roller 1001, intrudes into the liquid holding space S, and is mixed into the application liquid L filled in the same space S.

(3-4) Fixedly Adhered Liquid Removing Operation

Figure 22:
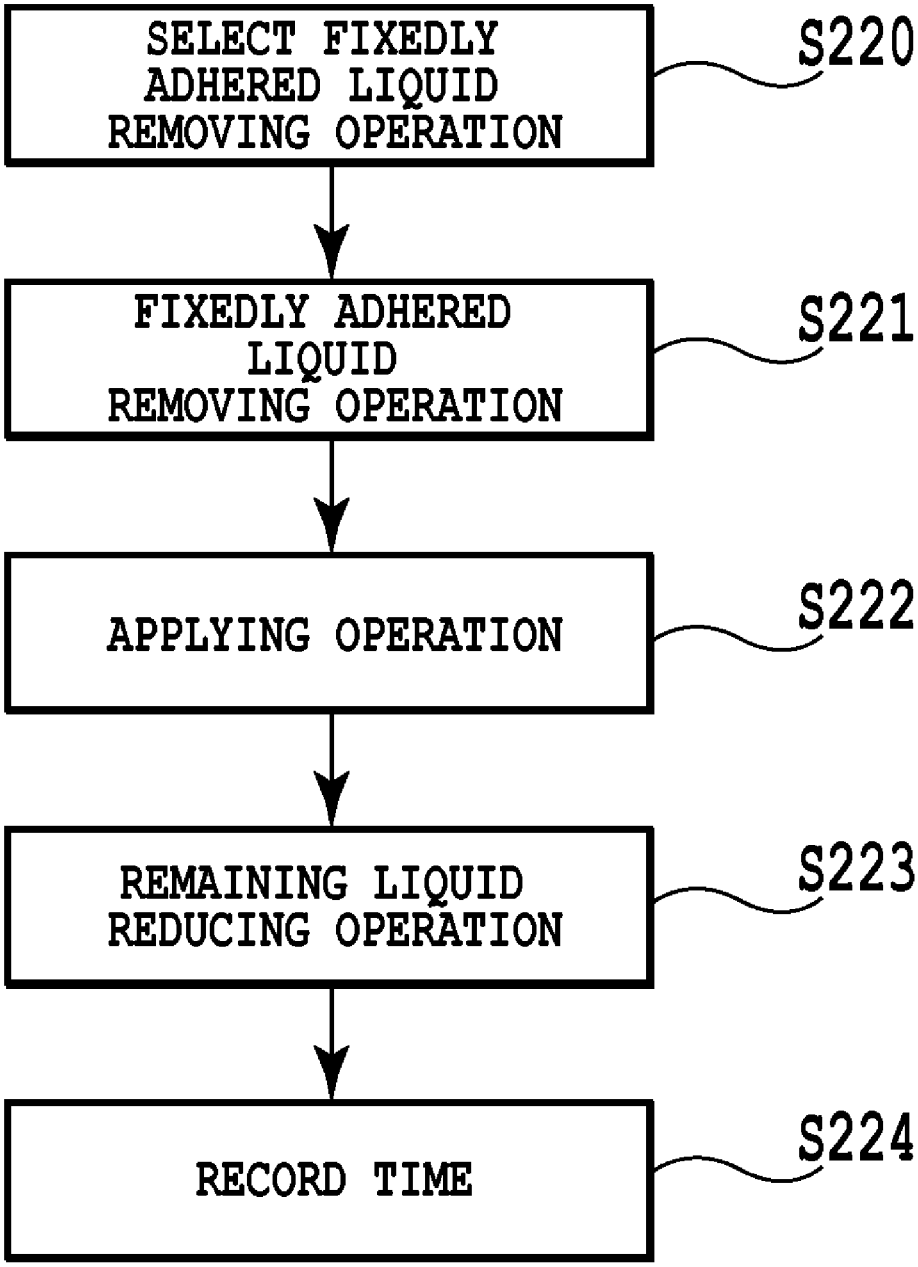
FIG. 22 is a flowchart explaining operation of a fixedly adhered liquid removing operation of the first embodiment of the present invention.

FIG. 22 is a flowchart explaining operation of a fixedly adhered liquid removing operation of the present embodiment. First, an elapsed time from the time of last driving is acquired, and an appropriate and pre-application fixedly adhered liquid removing operation is selected from fixedly adhered liquid removing operations prepared in advance (step S220). Based on the selected fixedly adhered liquid removing operation, the fixedly adhered liquid is removed (step S221). Then, after an applying operation (step S222) is performed, the post-application remaining liquid reducing operation is performed (step S223). Lastly, the fixedly adhered liquid removing operation time is updated for selecting a fixedly adhered liquid removing operation to be selected when an applying operation is performed next (step S224).

In the following, the fixedly adhered liquid removing operation of the present embodiment will be described in detail.

Figure 23:
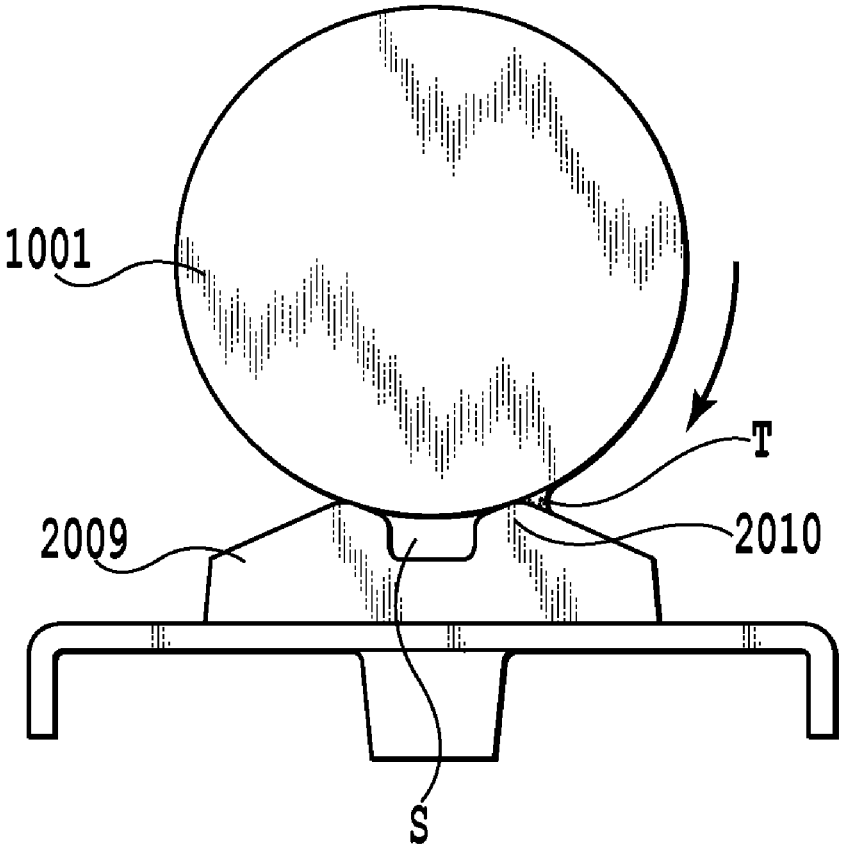
FIG. 23 is a schematic sectional view showing a nip portion between the application roller and abutting member of the first embodiment of the present invention.
Figure 24:
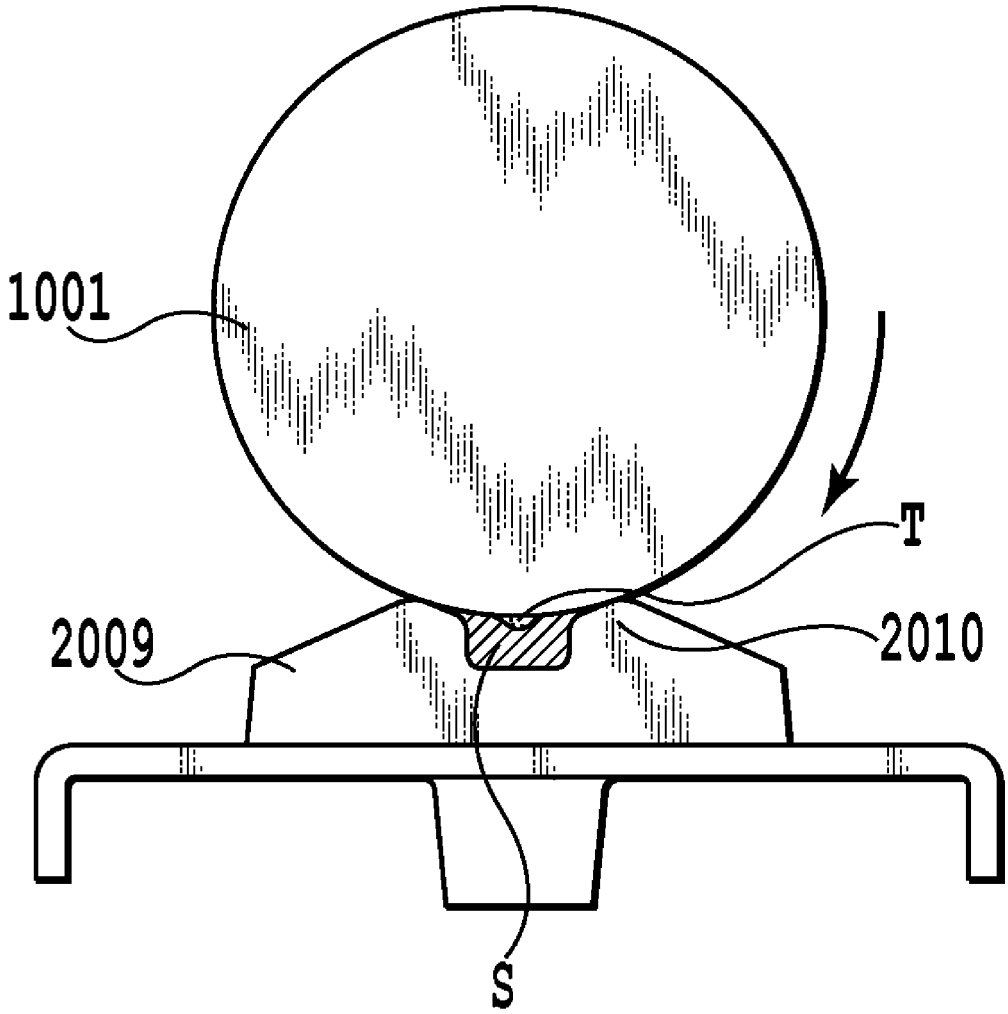
FIG. 24 is a schematic sectional view showing a nip portion between the application roller and abutting member of the first embodiment of the present invention.

FIG. 23 and FIG. 24 are schematic sectional views showing a nip portion between the application roller 1001 and abutting member 2009.

In the present embodiment, in the returning operation of the application liquid described above, most of the application liquid slides away between the upper edge portion 2010 of the abutting member 2009 and the application roller 1001. However, some of the application liquid is scraped away by the upper edge portion 2010 of the abutting member 2009, and there is also an application liquid remaining in the nip portion between the application roller 1001 and the abutting member 2009 and the vicinity thereof. Moreover, the application liquid may be shaped into drops depending on the surface tension of the liquid. When the application liquid is left standing in this state for a long time, moisture in the application liquid evaporates, so that the application liquid increased in viscosity is interposed on the surface of the application roller 1001. Further, when the application liquid is kept standing, only a nonvolatile content in the application liquid remains, and a phenomenon that the application liquid is fixedly adhered to the nip portion between the application roller 1001 and the abutting member 2009 occurs. When an applying operation is executed in a state where the application liquid has been increased in viscosity or fixedly adhered, a large amount of application liquid adheres to only a part, on the application roller 1001, corresponding to the nip portion with the abutting member 2009. As a result, a uniform application liquid layer cannot be formed on the application roller 1001, and application onto the applied medium P becomes nonuniform.

To cope therewith, making, before an applying operation, the volume of the liquid being held in the liquid holding space S with which the application roller 1001 makes contact in unit time larger than that in the applying operation makes it possible to promote redissolution of the fixedly adhered application liquid.

In the present embodiment, by executing, before an applying operation, a rotating operation of the application roller 1001 at a low speed, in a state where the application liquid has been filled in the liquid holding space S, without passing the applied medium P (hereinafter, referred to also as a "fixedly adhered liquid removing operation"), nonuniform application is avoided. As shown in FIG. 23, when the application roller 1001 is rotated in the arrow direction in the figure in the state where the application liquid has been increased in viscosity and fixedly adhered to the nip portion between the application roller 1001 and the abutting member 2009, the application liquid T increased in viscosity and fixedly adhered (hereinafter, referred to also as a "fixedly adhered liquid") adheres to the application roller 1001. Then, the fixedly adhered liquid T intrudes into the liquid holding space S, as shown in FIG. 24. At this time, the lower the rotating speed of the application roller 1001, the more the contact time of the fixedly adhered liquid T on the application roller 1001 with the application liquid L being held in the liquid holding space S is prolonged. As a result, the fixedly adhered liquid T is redissolved, and it thus becomes possible to remove the fixedly adhered liquid T. For this operation, it suffices that the application roller 1001 is at a low speed for, of one rotation thereof, at least, a period where the position, on the application roller 1001, against which the abutting member 2009 had been abutted before start-up passes through the liquid holding space S.

Moreover, at the time of rotation of the application roller in the fixedly adhered liquid removing operation, the rotating operation amount of the application roller 1001 may be increased so as to increase the time for which the fixedly adhered liquid T contacts the application liquid L interposed in the liquid holding space S. In the case of the present embodiment, by increasing the rotating operation amount of the application roller 1001, a force to scrape away the fixedly adhered liquid T by the upper edge portion 2010 of the abutting member 2009 is secondarily added, and the rotating operation becomes more effective.

Data from which application uniformity has been confirmed, using the present embodiment, by varying the rotating operation speed and rotating operation amount of the application roller 1001 at the time of the fixedly adhered liquid removing operation is shown in Table 2. In the present table, shown are data when the peripheral speed and the number of rotations of the application roller 1001 were varied under conditions corresponding to when it was left standing for 60 hours and when left standing for 120 hours. "o" indicates that there is no problem in application uniformity, "Δ" indicates that there is a slight application non-uniformity, and "x" indicates that there is application non-uniformity. It can be understood from the results that, for the problem of application non-uniformity due to the fixedly adhered liquid T, the rotating operation of the application roller 1001 is effective when at a low speed and a large amount of rotation.

TABLE 2

| | | | Rotating operation amount of application member [rotation] | | | | |
|---|---|---|---|---|---|---|---|
| | | | 1 | 2 | 3 | 4 | 5 |
| Corresponds to left standing for 60 hrs | Rotating speed of application member [inch/sec] | 2.0 | Δ | ○ | ○ | ○ | ○ |
| | | 3.3 | x | ○ | ○ | ○ | ○ |
| | | 5.3 | x | x | x | x | x |
| Corresponds to left standing for 120 hrs | Rotating speed of application member [inch/sec] | 2.0 | x | | ○ | ○ | ○ |
| | | 3.3 | x | x | Δ | Δ | — |
| | | 5.3 | x | x | x | x | x |

Moreover, when a standby time is provided in a state where the fixedly adhered liquid T on the application roller 1001 is in contact with the application liquid being held in the liquid holding space S (state shown in FIG. 24), redissolution of the fixedly adhered liquid T proceeds. Accordingly, it is also effective to include an operation to stop the rotation roller at the time of rotation of the application roller. As another control unit, rotation of the application roller 1001 is not limited only to one in a normal rotation direction shown by an arrow in the figure but may also be a reverse rotation operation, and a reverse rotation operation may be added at the time of rotation to perform a plurality of rotations by a combination of these. Further, a unit having a unit for raising the temperature of the application liquid held on the surface of the application roller 1001 or in the liquid holding space S, for melting the fixedly adhered liquid in a heated state is also effective.

Moreover, it is also effective to generate, in a state where the fixedly adhered liquid T is in contact with the application liquid being held in the liquid holding space S on the application roller 1001 (state shown in FIG. 24), a flow of the application liquid by use of a liquid supply unit, since redissolution of the application liquid is promoted. Further, by combination with the foregoing unit, a flow of the application liquid may be generated in the liquid holding space S in a state where driving of the application roller 1001 has been stopped.

In the present embodiment, during a fixedly adhered liquid removing operation, by using such a liquid supply unit to make the application liquid in the liquid holding member 2001 flow continuously or intermittently, redissolution of the fixedly adhered liquid T is accelerated. Since the liquid supply unit is a negative pressure circulating system, by increasing the speed of the pump 3007, the flow velocity in the liquid flow path 3000 and in the liquid holding space S is increased, and apparently, an abutting pressure of the liquid holding member 2001 against the application roller 1001 is increased. Therefore, secondarily, an effect to scrape away the fixedly adhered liquid T is enhanced.

The degree of increase in viscosity and fixed adhesion of the fixedly adhered liquid T varies depending on the standing time of the mechanism, as this is caused by evaporation of moisture of the application liquid L. The longer the standing time, the greater the degree of increase in viscosity and fixed adhesion is promoted. On the other hand, as described above, in the fixedly adhered liquid removing operation, although the lower the speed of rotation of the application roller 1001 or the longer the standby time, the greater the effect on removal of the fixedly adhered liquid is, there is also a disadvantage that the time to begin an applying operation is delayed. Therefore, when the standing time is short, the degree of fixed adhesion is also slight, and thus appropriately selecting the rotating speed or the amount of rotation of the application roller 1001 and the standby time makes it possible to shorten the fixedly adhered liquid removing operation in time.

More specifically, having an acquisition unit for acquiring information concerning the time of last driving, and calculating, by use of the acquisition unit, an elapsed time from that time at the time of a fixedly adhered liquid removing operation and selecting operation conditions according to a value thereof allows performing an effective fixedly adhered liquid removing operation.

In Table 3, shown are examples of a fixedly adhered liquid removing sequence in the present embodiment. In the present embodiment, an unillustrated electrical printing section is provided at a part of the control section 4000, the time where the applying operation has ended is stored in the printing section, and this is updated to the latest applying operation end time as needed. At the time of a fixedly adhered liquid removing operation, time of the last paper passing operation is acquired, an elapsed time from that time is calculated, and the rotating speed and the amount of rotation of the application roller 1001 are selected according to an output result thereof. Table 3 shows examples of the elapsed time and driving conditions of the application roller 1001. In the present embodiment, efficiency of the start-up time is improved while application uniformity is secured. In addition, the rotation speed of the pump 3007 is increased at the time of a fixedly adhered liquid removing operation to promote redissolution of the fixedly adhered liquid T.

TABLE 3

| Standing time | |
|---|---|
| 55 sec or more and less than 15 min | 2.0 inch/sec 1 rotation + 3.3 inch/sec 1 rotation |
| 15 min or more and less than 3 hrs | 0.8 inch/sec 1 rotation + 3.3 inch/sec 1 rotation |
| 3 hrs or more and less than 60 hrs | 0.8 inch/sec 1 rotation + 3.3 inch/sec 1 rotation + 5.3 inch/sec 1 rotation |
| 60 hrs or more and less than 172 hrs | 0.8 inch/sec 1 rotation + 3.3 inch/sec 4 rotations + 5.3 inch/sec 1 rotation |
| 172 hrs or more | 0.67 inch/sec 1 rotation + 2.0 inch/sec 4 rotations + 5.3 inch/sec 1 rotation |

Further, in the present embodiment, an operation to reduce the amount of the application liquid that will remain on the surface of the application roller 1001 (hereinafter, referred to also as a "remaining liquid reducing operation") is performed after end of the applying operation for reducing the amount of the application liquid that will remain in the abutting portion between the application roller 1001 and the abutting member 2009. The slower the rotation speed of the application roller 1001, the less the application liquid adheres onto the application roller 1001 according to Newton's law of viscosity. Moreover, as described above, since the negative pressure value in the liquid holding space S is increased when the rotation speed of the pump 3007 is increased, the apparent abutting pressure of the abutting member 2009 against the application roller 1001 is increased, and the amount of the application liquid to flow out of the liquid holding member 2001 is reduced. Combining these operations allows greatly reducing the amount of the application liquid that will remain on the application roller 1001. As a result, the amount of the application liquid that remains between the application roller 1001 and the abutting member 2009 and in the vicinity thereof is reduced, so that the amount of the fixedly adhered liquid T can be reduced.

Also, even in a mechanism where no hermetically sealed space is formed, since the phenomenon of increase in viscosity occurs if there is a contact between the liquid level and application member, the above-mentioned unit is effective.

(3-5) Ending Process

Returning again to FIG. 12, when an applying operation onto an applied medium is executed, it is next judged whether the applying process may be completed (step S6). If the applying process may not be completed, the process returns to step S5, where the applying operation is repeated until the applying process is completed for the entire part of the applied medium that needs application. When the applying process is completed, driving of the pump 3007 is stopped (step S8). Thereafter, the process shifts to step S2, and if the application start command has been input, the operation of steps S2 to S8 is repeated. On the other hand, if the application start command has not been input, a post processing such as a recovery operation to recover the application liquid in the holding space S and the liquid flow path is performed (step S9), and the processing relating to application is completed.

Also, the pump 3007 may be stopped in synchronization with driving of the application roller 1001 in the fixedly adhered liquid removing operation, not stopping the pump 3007 in step S8.

Moreover, for the recovery operation, the respective shutoff valves are set to an opening and closing combination of "recovery," and the pump 3007 is driven for a certain period of time. This opening and closing combinational lows the buffer tank 3002 to communicate with the liquid holding space S through the second flow path and the first flow path to communicate with a communication port 3004 being an atmospheric air communication port for the liquid holding space S. Thereby, the atmospheric air is supplied to the tube 3102, the liquid holding space S, the tube 3103, the tube 3104, the pump 3007, and the tube 3105, and the application liquid L that has been filled is recovered into the buffer tank 3002. By performing this recovery operation, evaporation of the application liquid from the liquid holding space S can be completely prevented or reduced.

Also, after the recovery operation, the respective shutoff valves are set to an opening and closing combination of "standing." By this opening and closing combination, the replacement tank 3001, the buffer tank 3002, and the liquid holding space S are shut off from each other. Accordingly, a movement of the application liquid L between the tanks or outflow to the outside can be completely prevented or reduced even if the posture of the apparatus is tilted during movement, transportation, and the like.

Although, in the present embodiment, replenishment of the buffer tank 3002 with the application liquid from the replacement tank 3001 and circulation of the application liquid for the liquid holding space S are separately performed, these may be simultaneously performed. In this case, it suffices to close the second shutoff valve 3202 and open the first shutoff valve 3201 and the third shutoff valve 3203 to the fifth shutoff valve 3205.

Second Embodiment

Although, in the first embodiment, a description has been given of the liquid application apparatus, the present invention can also be applied to an inkjet printing apparatus including the liquid application apparatus described above.

Figure 25:
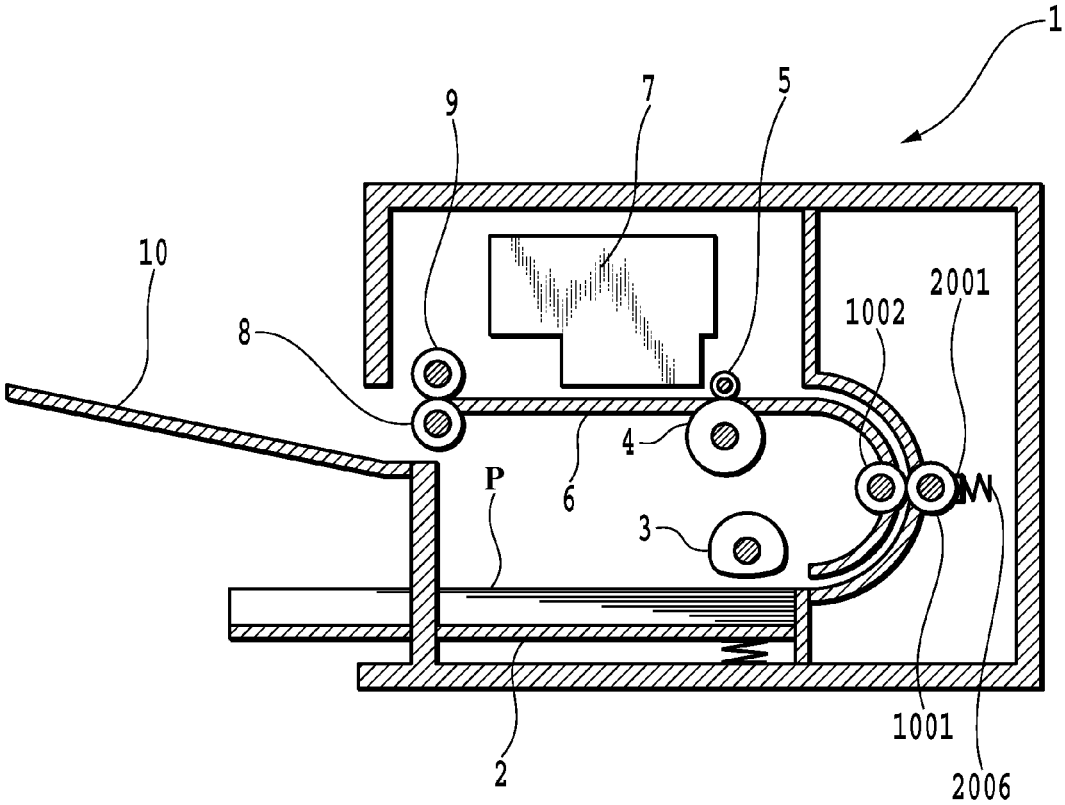
FIG. 25 is a schematic view showing an inkjet printing apparatus of a second embodiment of the present invention.

FIG. 25 is a schematic view showing an inkjet printing apparatus of the present embodiment. In the inkjet printing apparatus 1 of the present embodiment, a feed tray 2 on which a plurality of printing media P are placed is provided. A separation roller 3 of a semicircular shape separates and feeds the printing media P placed on the feed tray 2 one at a time to a conveyance path. In the conveyance path, the application roller 1001 and a counter roller 1002 that form a liquid application unit of a liquid application mechanism are arranged. The printing medium P fed from the feed tray 2 is conveyed to a portion between the rollers 1001 and 1002. The application roller 1001 is rotated in the clockwise direction in FIG. 17 by a rotation of the roller drive motor, and applies the application liquid L to the printing surface of the printing medium P while conveying the printing medium P. The printing medium P applied with the application liquid L is fed into a portion between a conveying roller 4 and a pinch roller 5, and by the conveying roller 4 rotating in the counterclockwise direction in FIG. 25, the printing medium P is conveyed on a platen 6. The printing medium P is then transferred to a position opposing a printing head 7 that forms a printing unit. The printing head 7 is an inkjet printing head on which a predetermined number of nozzles for ink ejection are disposed, and while the printing head 7 performs scanning in the direction orthogonal to the conveying direction of the printing medium P, ink drops are ejected from the nozzles onto the printing surface of the printing medium P according to printing data. By alternately repeating this printing operation and a predetermined amount of conveying operation by the conveying roller 4, an image is formed on the printing medium P. With this image forming operation, the printing medium P is sandwiched by a paper discharge roller 8 and a paper discharge spur 9 provided at the downstream side of a scanning area of the printing head 7 in the conveyance path of the printing medium, and discharged onto a paper discharge tray 10 by a rotation of the paper discharge roller 8.

Also, the printing apparatus of the present invention is not limited to a serial-type inkjet printing apparatus, but may be, for example, a so-called full line-type inkjet printing apparatus, which performs a printing operation using a long printing head with nozzles for ejecting ink disposed over the maximum width of a printing medium.

Moreover, the application liquid L to be used in the present embodiment is a processing liquid to accelerate coagulation of pigment in the case of printing with an ink using the pigment as a coloring material. Using a processing liquid as the application liquid allows making the processing liquid react with pigment that is the coloring material of an ink to be ejected to a printing medium P applied with the processing liquid so as to accelerate coagulation of the pigment. This insolubilization can improve the printing density. Further, it becomes possible to reduce or prevent bleeding. As a matter of course, the application liquid to be used in the inkjet printing apparatus is not limited to the example described above.

Figure 26:
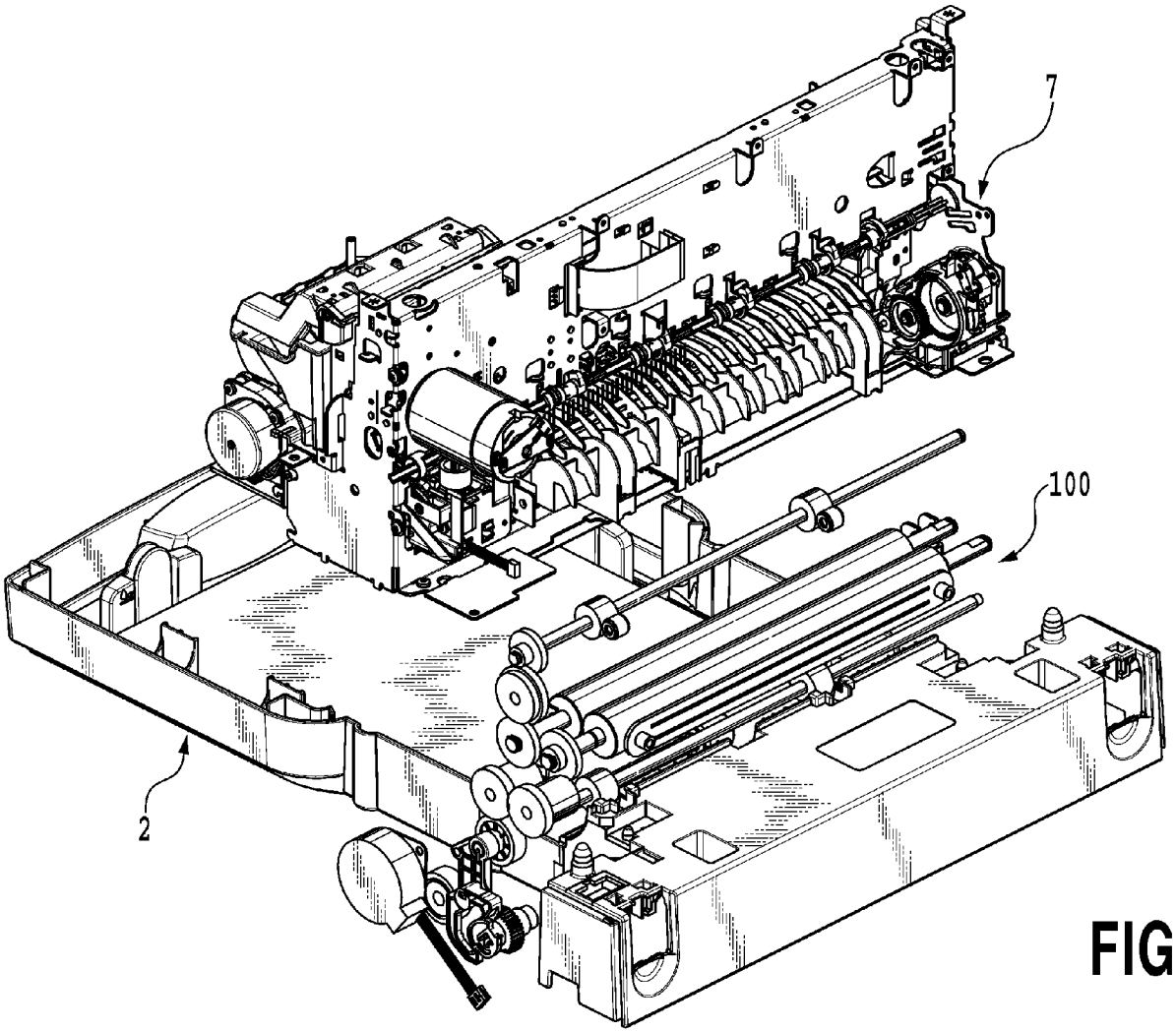
FIG. 26 is a perspective view showing a main part of the inkjet printing apparatus of the second embodiment of the present invention.

FIG. 26 is a perspective view showing a main part of the inkjet printing apparatus of the present embodiment. An application mechanism 100 is provided above one end of the feed tray 2, and a printing mechanism provided with the printing head 7 etc., above a central portion of the feed tray 2 is provided above the application mechanism.

Figure 27:
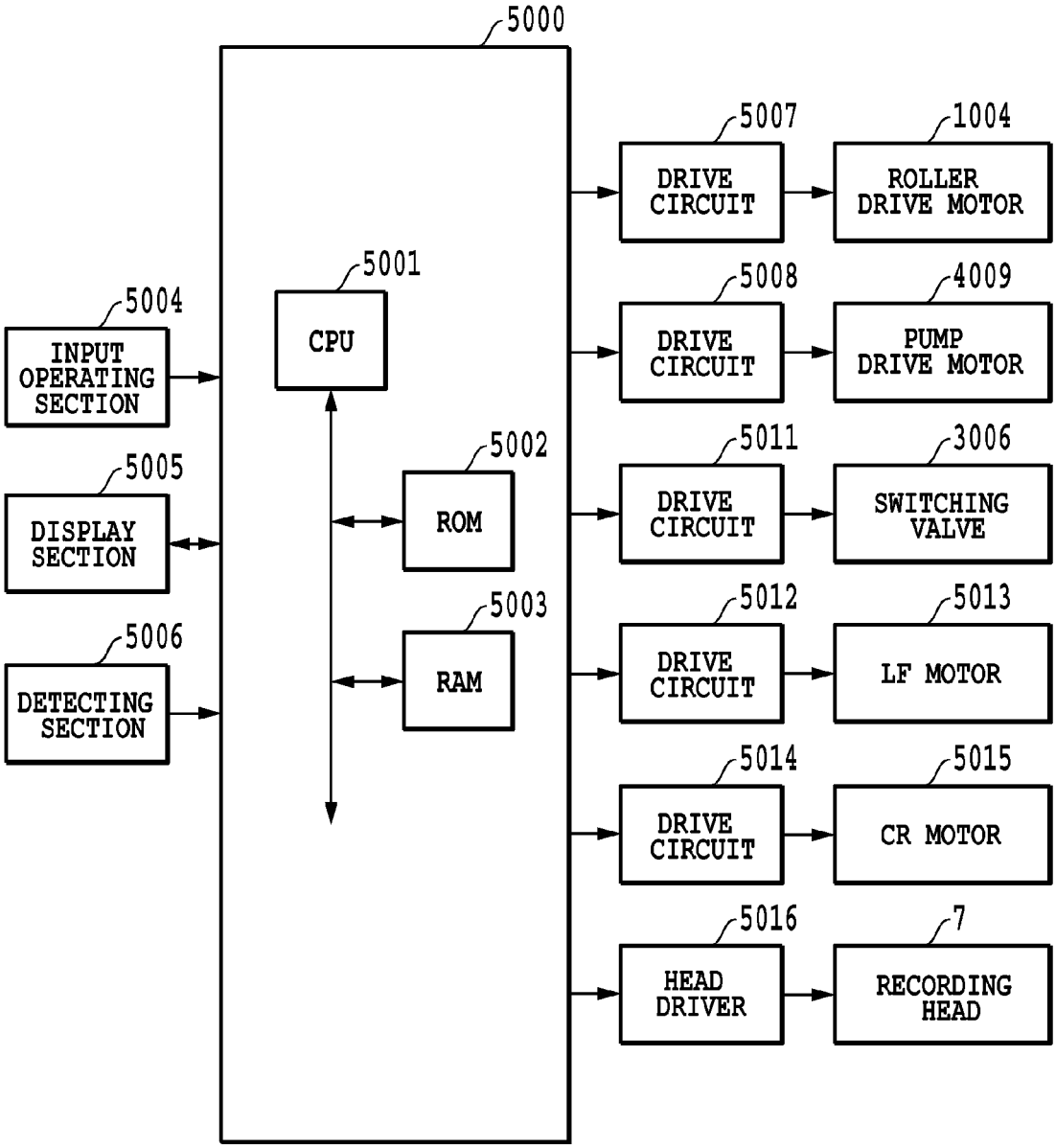
FIG. 27 is a block diagram showing a schematic configuration of a control system of the inkjet printing apparatus of the second embodiment of the present invention.

FIG. 27 is a block diagram showing a schematic configuration of a control system of the inkjet printing apparatus of the present embodiment. The roller drive motor 1004 and the pump drive motor 4009, which are elements of the liquid application mechanism, are the same elements as those of the liquid application mechanism of the first embodiment. A CPU 5001 controls driving of the respective elements of the application mechanism according to a processing procedure to be described later. The CPU 5001 also controls driving of an LF motor 5013, a CR motor 5015, and the printing head 7 relating to the printing mechanism via their respective drive circuits 5012, 5014, and 5016. More specifically, driving of the LF motor 5013 rotates the conveying roller 4, and driving of the CR motor 5015 moves a carriage loaded with the printing head 7. The CPU 5001 further performs control to eject ink from the nozzles of the printing head 7.

Figure 28:
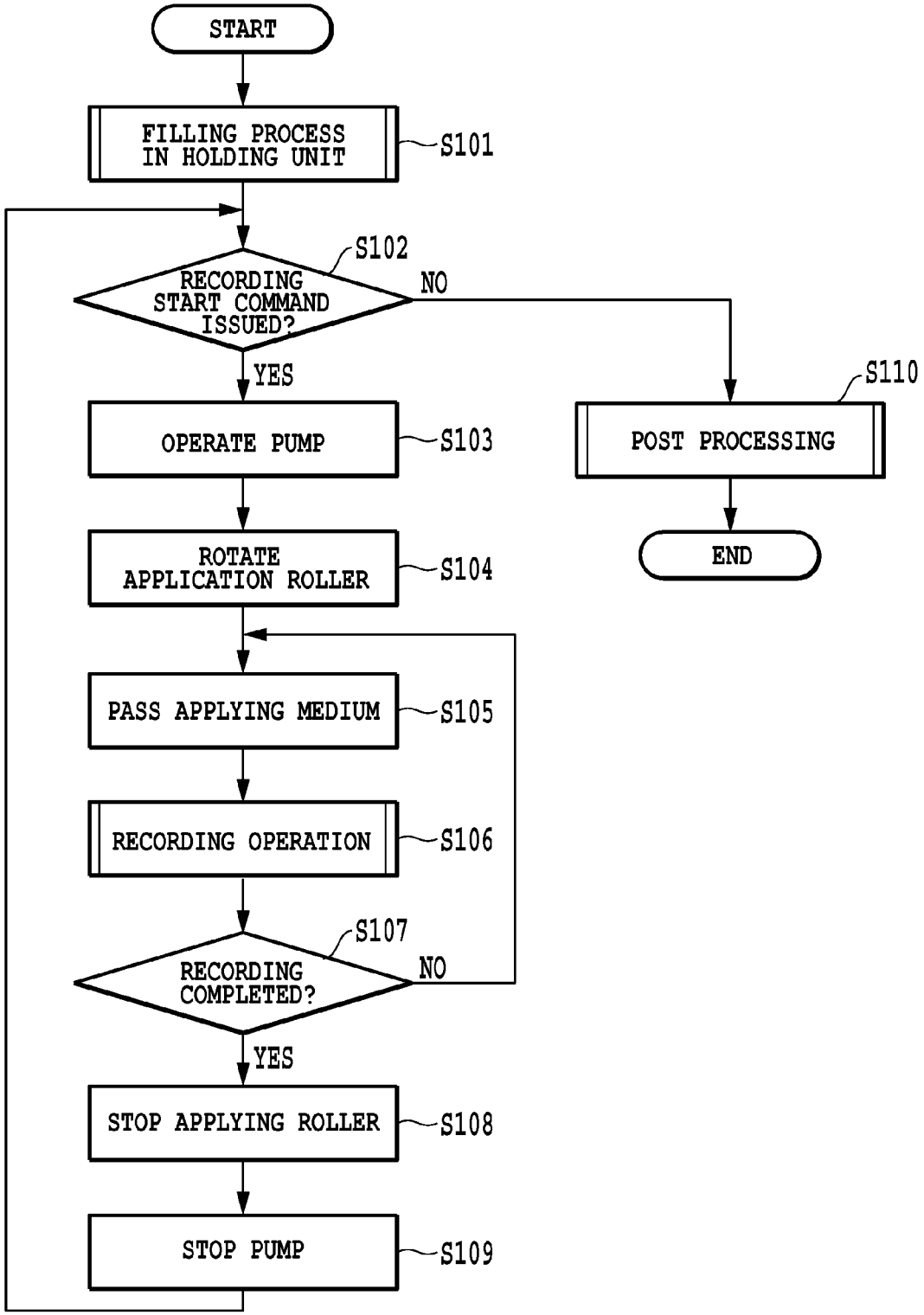
FIG. 28 is a flowchart showing a procedure for liquid application and a printing operation resulting therefrom in the inkjet printing apparatus of the second embodiment of the present invention.

FIG. 28 is a flowchart showing a procedure for liquid application and a printing operation resulting therefrom in the inkjet printing apparatus of the present embodiment.

In the same figure, the processing in steps S101 and S103 to S105 and the processing in steps S108 to S110 are the same as the processing in step S1, S3 to S5, and S8 to S9 shown in FIG. 12 of the first embodiment, respectively.

As shown in FIG. 28, in the present embodiment, when a command to start printing is issued (step S102), a series of liquid application operations including a pump operation is performed (steps S103 to S105). Thereby, the liquid is applied to a part of the printing medium that needs liquid application. Before and after the applying operation, the foregoing fixedly adhered liquid removing operation is performed according to necessity.

After this applying process, a printing operation is performed for the printing medium applied with the application liquid at a part that needs application (step S106). More specifically, the printing head 7 is made to scan the printing medium P that is conveyed in predetermined amounts by the conveying roller 4, and ink is ejected from the nozzles according to the printing data in the course of the scanning and the ink thereby adhered to the printing medium to form dots thereon. Since the adhered ink reacts with the application liquid, it becomes possible to improve the density and prevent bleeding. By repeating the above conveyance of the printing medium and scanning with the printing head, printing is carried out for the printing medium P, and the printing medium for which printing has been completed is discharged onto the paper discharge tray 10. When it is judged in step S107 that printing has been completed, the processing in step S108 onward is performed, and the present process is completed.

In the present embodiment, with liquid application onto the printing medium, printing is sequentially performed onto parts thereof where the application has been completed. More specifically, this is an embodiment where the length of the conveyance path from the application roller to the printing head is shorter than the length of the printing medium, and when a part of the printing medium applied with the liquid reaches the scanning area by the printing head, application is performed by the application mechanism to another part of the printing medium. Owing to this embodiment, liquid application and printing are subsequently performed, for every predetermined amount of conveyance of the printing medium, at different parts of the printing medium. However, the present invention is not limited to such an embodiment, printing may be performed after application onto one printing medium is completed.

Also, in the printing apparatus of the present embodiment, the whiteness degree of the medium can be improved by applying a liquid containing a fluorescent whitening agent by the liquid application mechanism. In this case, the printing unit after liquid application is not limited to the inkjet printing method, but the effect can be obtained also by a printing method such as a thermal transfer method and an electrophotographic method. Also, when the present invention is applied to a printing apparatus by a silver-salt photographic method, a photosensitizing agent may be applied before printing.

That is, the present invention is by no means limited to being applied to an inkjet printing apparatus, but can be applied to any printing apparatus having a mechanism for applying a liquid such as a processing liquid to a printing medium.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-013066, filed Jan. 23, 2008 which is hereby incorporated by reference herein in its entirety.

What is claimed is:

1. A liquid application apparatus, comprising:

an application roller that applies a liquid onto a sheet;

a holding member that abuts against the application roller to form a liquid holding space for holding the liquid; and a controller configured to control the application roller to rotate such that liquid in the liquid holding space contacts adhered material remaining on the application roller, thereby performing a preliminary operation of dissolving the adhered material that is fixedly adhered on the application roller, prior to performing an applying operation of applying the liquid onto the sheet with the application roller, and wherein a total period of time that the liquid in the liquid holding space contacts the adhered material in the preliminary operation is set to be changed based on an elapsed time since a last applying operation.

2. The liquid application apparatus according to claim 1, wherein the controller is further configured to change a volume of liquid held in the liquid holding space.

3. The liquid application apparatus according to claim 1, wherein the controller is further configured to change the total period of time by setting a rotating speed of the application roller to be smaller in the preliminary operation than in the applying operation based on the elapsed time since the last applying operation.

4. The liquid application apparatus according to claim 1, wherein the controller is further configured to change the total period of time by setting a number of rotations of the application roller in the preliminary operation based on the elapsed time since the last applying operation.

5. The liquid application apparatus according to claim 1, wherein the controller is further configured to change the total period of time by, in the preliminary operation, stopping the rotation of the application roller for a certain period of time based on the elapsed time since the last applying operation.

6. The liquid application apparatus according to claim 1, wherein the controller is further configured to change the total period of time by, in the preliminary operation, performing a reverse rotation of the application roller, with respect to a rotation direction in the applying operation, based on the elapsed time since the last applying operation.

7. The liquid application apparatus according to claim 1, wherein the controller is further configured to, in the preliminary operation, cause a liquid held in the liquid holding space to generate a flow.

8. The liquid application apparatus according to claim 1, wherein the controller is further configured to control the application roller to rotate after the applying operation, wherein a rotation speed of the application roller after the applying operation is lower than a rotation speed of the application roller in the applying operation.

9. A printing apparatus comprising:

a conveying unit for conveying a printing medium along a predetermined conveyance path;

a printing unit for performing printing on the printing medium;

a liquid application unit for applying a liquid to the printing medium, wherein the liquid application unit includes an application roller that applies the liquid onto the printing medium, and a holding member that abuts against the application roller to form a liquid holding space for holding the liquid; and a controller configured to control the application roller to rotate such that the liquid in the liquid holding space contacts adhered material remaining on the application roller, thereby performing a preliminary operation of dissolving the adhered material that is fixedly adhered on the application roller, prior to performing an applying operation of applying the liquid onto the sheet with the application roller, wherein a total period of time that the liquid in the liquid holding space contacts the adhered material in the preliminary operation is set to be changed based on an elapsed time since a last applying operation.

10. The printing apparatus according to claim 9, wherein the liquid application unit is arranged in the conveyance path on an upstream side of the printing unit.

11. A method for applying a liquid onto a sheet with an application member that includes an application roller, and a holding member that abuts against the application roller to form a liquid holding space for holding the liquid, the method comprising the steps of:

removing adhered material fixedly adhered and remaining on the application roller adjacent to a nip portion between the application roller and the holding member by causing the liquid in the liquid holding space to contact the adhered material prior to performing an applying operation;

performing the applying operation of applying the liquid onto the sheet with the application member; and changing a period of time for the removing step based on an elapsed time since a last applying operation.

* * * * *